US006419761B1

(12) United States Patent
Hashimura et al.

(10) Patent No.: US 6,419,761 B1
(45) Date of Patent: Jul. 16, 2002

(54) STEELS FOR COLD FORGING AND PROCESS FOR PRODUCING THE SAME

(75) Inventors: Masayuki Hashimura; Hideo Kanisawa, both of Muroran; Makoto Okonogi, Futtsu, all of (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/403,238

(22) PCT Filed: Mar. 4, 1999

(86) PCT No.: PCT/JP99/01049

§ 371 (c)(1),
(2), (4) Date: Oct. 15, 1999

(87) PCT Pub. No.: WO99/45162

PCT Pub. Date: Sep. 10, 1999

(30) Foreign Application Priority Data

Mar. 4, 1998 (JP) ..... 10 067642
Mar. 4, 1998 (JP) ..... 10 067641

(51) Int. Cl.[7] ..... C21D 8/00; C22C 38/02; C22C 38/04

(52) U.S. Cl. ..... 148/320; 148/333; 148/334; 148/330; 148/328; 148/654

(58) Field of Search ..... 148/654, 320, 148/333, 334, 330, 328

(56) References Cited

U.S. PATENT DOCUMENTS 5,476,556 A * 12/1995 Hoshino et al. ..... 148/654
5,830,285 A * 11/1998 Katayama et al. ..... 148/654

FOREIGN PATENT DOCUMENTS

| | | |
|---|---|---|
| JP | 62-23929 | 1/1987 |
| JP | 62-196327 | 8/1987 |
| JP | 2-111842 | 4/1990 |
| JP | 2-145745 | 6/1990 |
| JP | 3-146618 | 6/1991 |
| JP | 5-26850 | 4/1993 |
| JP | 7-5960 | 1/1995 |
| JP | 7-242990 | 9/1995 |
| JP | 8-283847 | 10/1996 |
| JP | 8-291366 | 11/1996 |
| JP | 9-157786 | 6/1997 |

OTHER PUBLICATIONS

Notice of Grounds For Rejection by Korean Intellectual Property Office dated Aug. 27, 2001 along with English translation.

* cited by examiner

*Primary Examiner*—Deborah Yee
(74) *Attorney, Agent, or Firm*—Kenyon & Kenyon

(57) ABSTRACT

This invention provides a steel for cold forging, excellent in surface layer hardness and softening properties by annealing, which contains, in terms of wt %, C: 0.1 to 1.0%, Si: 0.1 to 2.0%, Mn: 0.01 to 1.50%, P: not greater than 0.100%, S: not greater than 0.500%, sol. N: not greater than 0.005% and the balance consisting of Fe and unavoidable impurities, wherein a pearlite ratio in the steel structure is not greater than 120×(C %) % and the outermost surface layer hardness is at least 450×(C %)+90 in terms of the Vickers hardness HV, and a production method thereof. The invention provides also a steel for cold forging, which has a structure wherein a ratio of graphite amount to the carbon content in the steel exceeds 20%, a mean grain diameter of graphite is not greater than $10\times(C\ \%)^{1/3}$ $\mu$m and a maximum grain diameter is not greater than 20 $\mu$m.

6 Claims, 11 Drawing Sheets

STEELS FOR COLD FORGING AND PROCESS FOR PRODUCING THE SAME

TECHNICAL FIELD

This invention relates to a structural steel that is subjected to cold forging, either as-rolled or after rolling and annealing, and a method of producing such a steel.

BACKGROUND ART

Steels used for structural members are passed through various forming processes in order to impart required properties to them. Radio-frequency hardening, for hardening the surface layer, is one of these processes. Since such structural members are required to have only a high surface layer hardness, in most cases, an increase in the number of processes results in an increase of the cost of production, and this has been one of the problems in the past. Since as-rolled materials of the conventional structural steels have a low cooling rate, they have a ferrite-pearlite structure in most cases. However, their surface layer hardness is low and never reaches the level achievable by radio-frequency hardening. More often than not, the surface layer hardness is lower than the internal hardness due to the influence of decarburization, and so forth. Though ordinary members need not always have a maximum hardness corresponding to the C (carbon) content brought forth by radio-frequency hardening, it is undeniable that some of the members are required to have a hardness higher than that of the annealed materials. Therefore, the provision of steels having, as-rolled, a higher surface layer hardness than the internal hardness has been another problem.

When complicated shapes are required, the steel materials are passed through forging and cutting processes. Because hot forging needs heating and has a low forming accuracy, cold forging, having higher forming accuracy, has been preferred. Nonetheless, conventional as-rolled materials are not suitable for cold forging because the hardness is too high. Ordinary steels for cold forging are generally softened by spheroidizing cementite. The annealing time is extremely long and is as much as about 20 hours.

The prior art references such as Japanese Unexamined Patent Publication (Kokai) No. 3-140411 describe that cold formability and cuttability of even a steel having a carbon content equivalent to the level of carbon steels for cold forging can be improved by graphitizing carbon and converting the steel structure to a ferrite-graphite dual phase. However, annealing for a long time is necessary to achieve such a structure, and the problems of production efficiency and production cost are left unsolved. In other words, the problem of shortening the annealing time is yet to be solved.

In order to reduce the graphitization annealing time, a technique has been suggested which adds B and uses BN as precipitation nuclei. However, when such a specific precipitate is used, a temperature-retaining process, in the BN precipitation temperature range, is necessary before annealing is conducted, and an additional annealing process becomes necessary. If this heat-treatment is conducted conjointly by rolling or hot forging, temperature control must be conducted extremely strictly until annealing, and this is virtually impossible.

In other words, the precipitation temperature of BN is believed to be from about 850 to about 900° C., but rolling and hot forging are actually carried out at a temperature higher than 1,000° C. in many cases. Therefore, in order to use such a graphite-containing steel for cold forging, rolling and hot forging, as prior processes, must be conducted at a temperature below 1,000° C. Hot forming at such a temperature lowers the service life of tools such as rolls and punches. The increase of the number of limitations on the processes leads to the drop of production efficiency, and must be therefore avoided to restrict the increase of the production cost. From the aspects of steel making and hot forging, as a prior process to cold forging, steel materials that do not need strict temperature control and can be annealed and softened within a short time have been required.

Japanese Unexamined Patent Publication (Kokai) No. 2-111842 teaches shortening the annealing time by restricting the graphite content within a short time. However, this technology does not provide a fundamental solution because cold forgeability and cuttability are deteriorated in proportion to the amount of cementite that remains in the steel materials as a result of suppression of the graphite content.

As described above, the conventional as-rolled materials are not entirely satisfactory because their surface layer hardness is not sufficient when they are used as such, but it is too high when they are subjected to cold forging and cutting. From the viewpoint of production, on the other hand, there is the fundamental problem that the steels should preferably be produced collectively by reducing the number of their kinds in order to reduce the cost of production. Therefore, it has been desired that the as-rolled materials have a sufficient surface hardness, the annealing time can be shortened when the as-rolled materials are subjected to cold forging, and they can exhibit excellent cold forgeability after annealing.

When strength is also further required, it may be possible, in principle, to add those elements which do not impede graphitization for improving hardenability but can improve hardenability. Particularly when the surface hardness by radio-frequency hardening is necessary, hardenability becomes more different problem because of increase the thickness of the hardened layer. However, since ordinary hardenability improving elements such as Cr, Mn, Mo, etc, hinder graphitization, the amounts of addition are limited. When the graphitization annealing time is shortened by forming BN, B cannot be used as the hardenability improving element, and the hardening depth cannot be sufficiently secured, either.

Under the above-described condition, a steel which makes it possible to reduce the annealing time, and is excellent in cold forgeability after annealing, hardenability and cuttability, has been required.

DISCLOSURE OF THE INVENTION

It is an object of the present invention to provide a steel that has, as-rolled, excellent surface hardness, by regulating the chemical components of the steel and its microstructure, and can impart excellent cold forgeability within an extremely short softening/annealing time before cold forging and cutting, and to provide a method of producing the steel.

It is another object of the present invention to provide a steel, for cold forging after annealing, that can shorten the annealing time, by regulating the chemical components of the steel, is excellent in cold formability and cuttability after annealing and has excellent strength and toughness after hardening and tempering.

To accomplish these objects, the present invention provides the following inventions.

(1) The first invention provides a steel for cold forging, excellent in surface layer hardness and softening properties by annealing, that contains, in terms of wt %, C: 0.1 to 1.0%, Si: 0.1 to 2.0%, Mn: 0.01 to 1.50%, P: not greater than 0.100%, S: not greater than 0.500%, sol. N: being limited to not greater than 0.005%, and the balance consisting of Fe and unavoidable impurities, wherein a pearlite ratio in the steel structure (pearlite occupying area ratio in microscope plate/microscope plate area) is not greater than 120×(C %) % (with the maximum being not greater than 100%), and the outermost surface layer hardness is at least 450×(C %)+90 in terms of the Vickers hardness HV.

(2) The second invention provides a steel for cold forging, excellent in surface layer hardness and softening properties by annealing, which contains at least one of Cr: 0.01 to 0.70% and Mo: 0.05 to 0.50%, in addition to the chemical components of the first invention (1) described above, wherein a pearlite ratio in the steel structure (pearlite occupying area ratio in microscope plate/microscope plate area) is not greater than 120×(C %) %, and the outermost surface layer hardness is at least 450×(C %)+90 in terms of the Vickers hardness HV.

(3) The third invention provides a steel for cold forging, excellent in surface layer hardness and softening properties by annealing, which contains at least one of Ti: 0.01 to 0.20%, V: 0.05 to 0.50%, Nb: 0.01 to 0.10%, Zr: 0.01 to 0.30% and Al: 0.001 to 0.050% in addition to the chemical components of the paragraph (1) or (2) described above, wherein a pearlite ratio in the steel structure (pearlite occupying area ratio on microscope plate/microscope plate area) is not grater than 120×(C %) %, and the outermost surface layer hardness is at least 450×(C %)+90 in terms of the Vickers hardness Hv.

(4) The fourth invention provides a steel for cold forging, excellent in surface layer hardness and softening properties by annealing, which contains B: 0.0001 to 0.0060% in addition to the chemical components of any of the paragraphs (1) to (3), wherein a pearlite ratio in the steel structure (pearlite occupying area ratio on microscope plate/microscope plate area) is not greater than 120×(C %) %, and the outermost layer surface hardness is at least 450×(C%)+90 in terms of the Vickers hardness Hv.

(5) The fifth invention provides a steel for cold forging, excellent in surface layer hardness and softening properties by annealing, which contains Pb: 0.01 to 0.30%, Ca: 0.0001 to 0.0020%, Te: 0.001 to 0.100%, Se: 0.01 to 0.50% and Bi: 0.01 to 0.50% in addition to the chemical components of any of the paragraphs (1) to (4), wherein a pearlite ratio in the steel structure (pearlite occupying area ratio in microscope plate/microscope plate area) is not greater than 120×(C %) %, and the outermost layer hardness is at least 450×(C %)+90 in terms of the Vickers hardness Hv.

(6) The sixth invention provides a steel for cold forging, excellent in surface layer hardness and softening properties by annealing, which contains Mg: 0.0005 to 0.0200% in addition to said chemical components according to any of claims 1 through 6, wherein a pearlite ratio in the steel structure (pearlite occupying area ratio on microscope plate/microscope plate area) is not greater than 120×(C %) %, and the outermost surface layer hardness is at least 450×(C %)+90 in terms of the Vickers hardness HV.

(7) The seventh invention provides a steel for cold forging, excellent in cold formability, cuttability and radio-frequency hardenability, which contains, in terms of wt %, C: 0.1 to 1.0%, Si: 0.1 to 2.0%, Mn: 0.01 to 1.50%, P: not greater than 0.100%, S: not greater than 0.500, sol. N: being limited to not greater than 0.005% and the balance consisting of Fe and unavoidable impurities, and has a structure wherein a ratio of graphite amount to the carbon content in the steel (graphitization ratio: amount of carbon precipitated as graphite/carbon content in the steel) exceeds 20%, a mean crystal grain diameter of the graphite is not greater than $10\times(C\ \%)^{1/3}$ μm and the maximum crystal grain diameter is not greater than 20 μm.

(8) The eighth invention provides a steel for cold forging, excellent in cold formability, cuttability and radio-frequency hardenability, which contains at least one of Cr: 0.01 to 0.70% and Mo: 0.05 to 0.50%, and has a structure wherein a ratio of graphite amount to the carbon content in the steel (graphitization ratio: amount of carbon precipitated as graphite/carbon content in the steel) exceeds 20%, a mean crystal grain diameter of the graphite is not greater than $10\times(C\ \%)^{1/3}$ μm , and a maximum crystal grain diameter is not greater than 20 μm.

(9) The ninth invention provides a steel for cold forging, excellent in cold formability, cuttability and radio-frequency hardenability, which contains at least one of Ti: 0.01 to 0.20%, V: 0.05 to 0.50%, Nb: 0.01 to 0.10%, Zr: 0.01 to 0.30% and Al: 0.001 to 0.050% in addition to the chemical components described in the paragraph (7) or (8), and has a structure wherein a ratio of graphite amount to the carbon content in the steel (graphitization ratio: amount of carbon precipitated as graphite/carbon content in the steel) exceeds 20%, a mean crystal grain diameter of the graphite is not greater than $10\times(C\ \%)^{1/3}$ μm, and a maximum crystal grain diameter is not greater than 20 μm.

(10) The tenth invention provides a steel for cold forging, which contains B: 0.0001 to 0.0060% in addition to the chemical components of any of the paragraphs (7) to (9), and has a structure wherein a ratio of graphite amount to the carbon content in the steel (graphitization ratio: amount of carbon precipitated as graphite/carbon content in the steel) exceeds 20%, a mean crystal grain diameter of the graphite is not greater than $10\times(C\ \%)^{1/3}$ μm and a maximum crystal grain diameter is not greater than 20 μm.

(11) The eleventh invention provides a steel for cold forging, excellent in cold formability, cuttability and radio-frequency hardenability, which contains Pb: 0.01 to 0.30%, Ca: 0.0001 to 0.0020%, Te: 0.001 to 0.100%, Se: 0.01 to 0.50% and Bi: 0.01 to 0.50% in addition to the chemical components of any of the paragraphs (7) to (10), and has a structure wherein a ratio of a graphite amount to the carbon content in the steel (graphitization ratio: amount of carbon precipitated as graphite/carbon content in the steel) exceeds 20%, a mean crystal grain diameter of graphite is not greater than $10\times(C\ \%)^{1/3}$ μm, and a maximum crystal grain diameter is not greater than 20 μm.

(12) The twelfth invention provides a steel for cold forging, excellent in cold formability, cuttability and radio-frequency hardenability, which contains Mg: 0.0005 to 0.0200% in addition to the chemical components of any of the paragraphs (7) to (11), and has a structure wherein a ratio of graphite amount to the carbon content in the steel (graphitization ratio: amount of carbon precipitated as graphite/carbon content in the steel) exceeds 20%, a mean crystal grain diameter of the graphite is not greater than $10\times(C\ \%)^{1/3}$ μm, and a maximum crystal grain diameter is not greater than 20 μm.

(13) A method of producing a steel for cold forging, excellent in surface layer hardness and softening properties by annealing, which comprises the steps of rolling the steel having the chemical components of any of the paragraphs (1) to (6) described above in an austenite temperature zone or in an austenite-ferrite dual phase zone so that a pearlite ratio in the steel structure (pearlite occupying area ratio in microscope plate/microscope plate area) is not greater than 120×(C %) % and the outermost surface layer hardness is at least 450×(C %)+90 in terms of the Vickers hardness Hv; rapidly cooling the steel immediately after the finish of rolling at a rate of at least 1° C./s; and controlling a recuperative temperature to 650° C. or below.

BEST MODE FOR CARRYING OUT THE INVENTION

Figure 1:
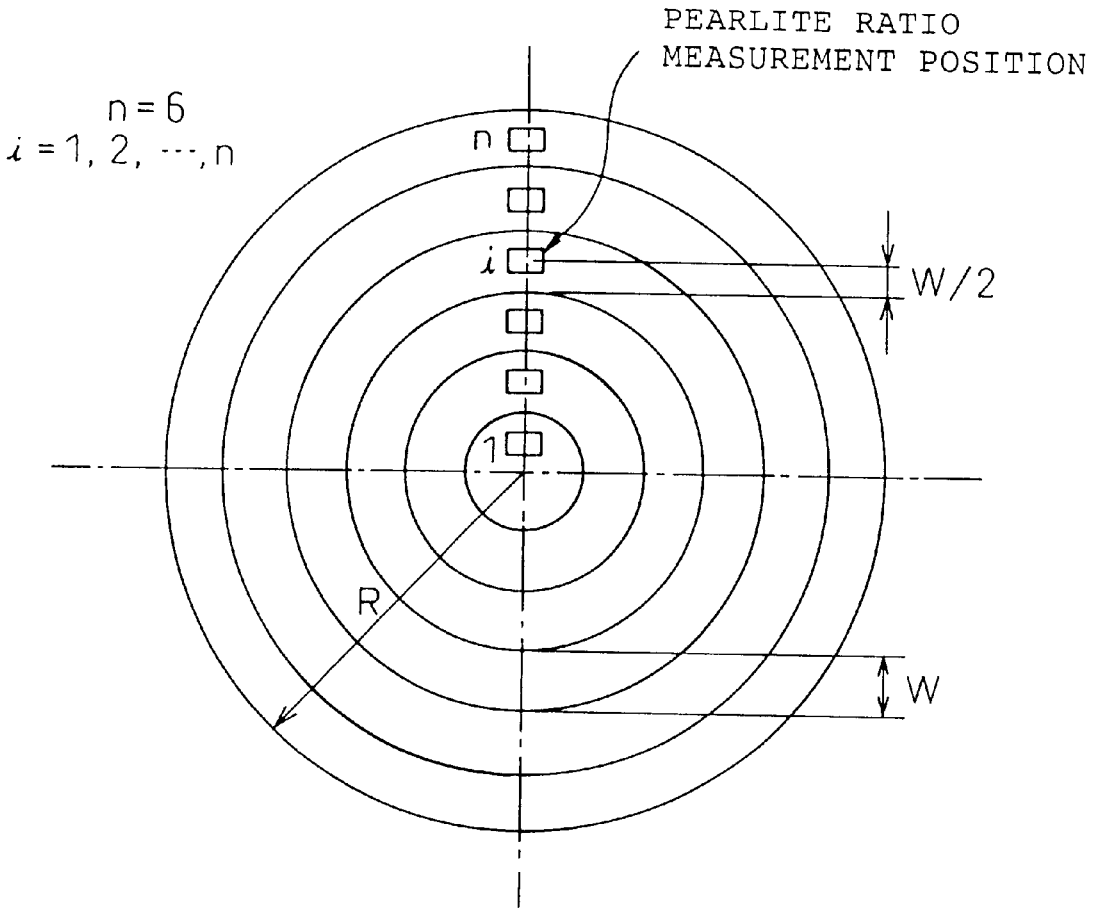
FIG. 1 is an explanatory view showing the outline of a pearlite ratio measuring method.
Figure 2:
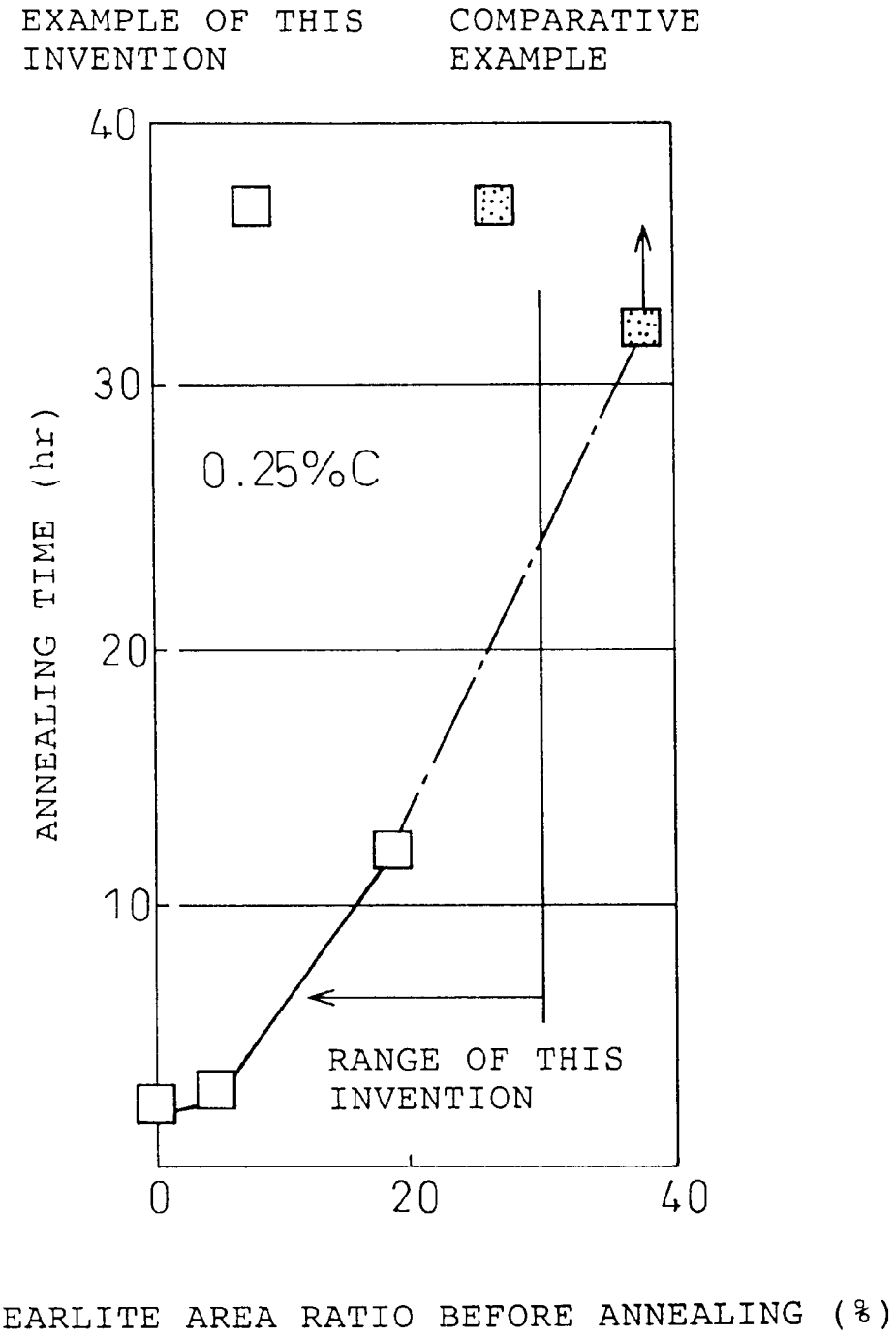
FIG. 2 is a graph showing the relation between a pearlite area ratio and an annealing time until softening in an embodiment of a 0.20% class.
Figure 3:
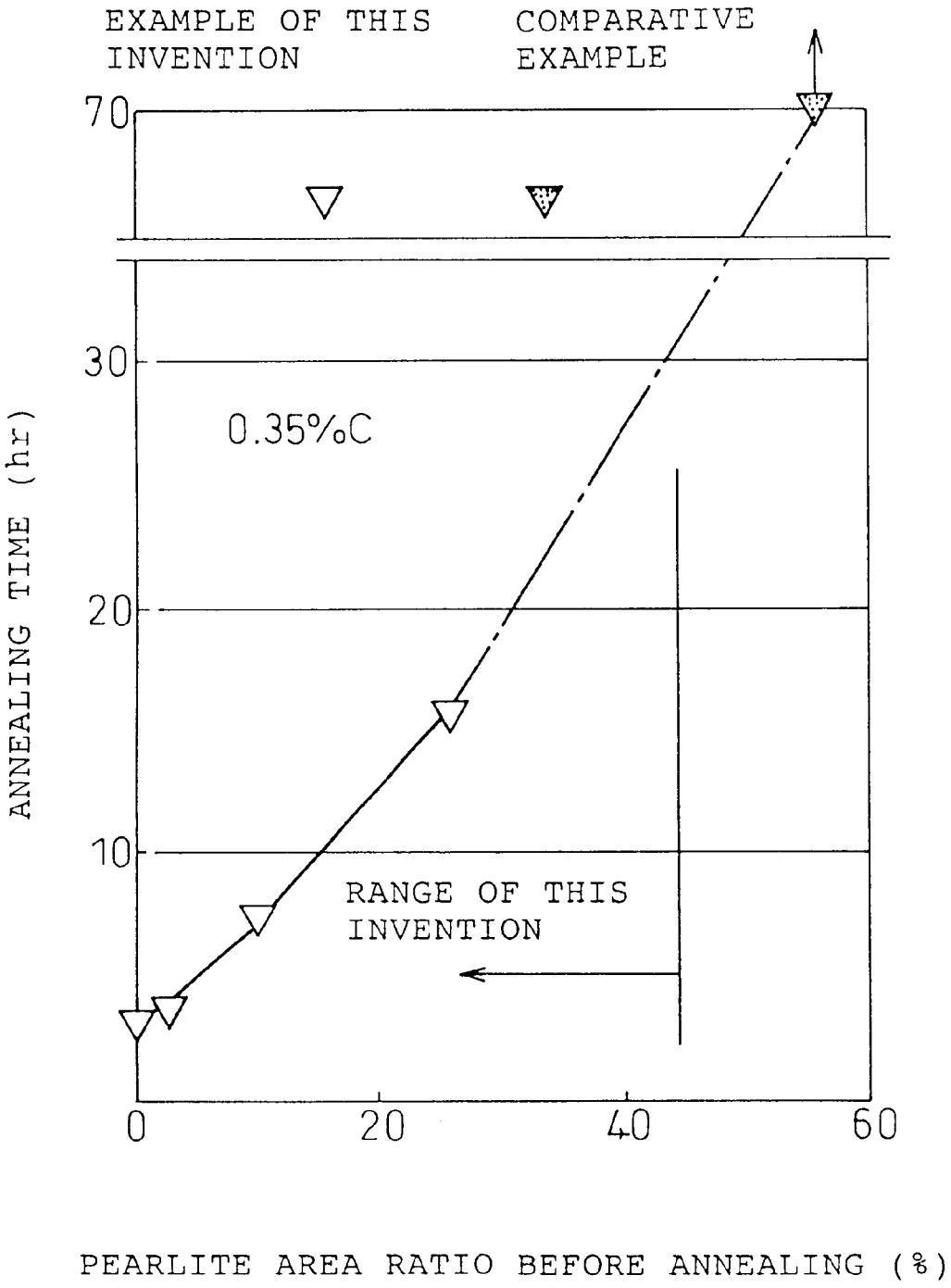
FIG. 3 is a graph showing the relation between the pearlite area ratio and the annealing time until softening in an embodiment of a 0.35% class.
Figure 4:
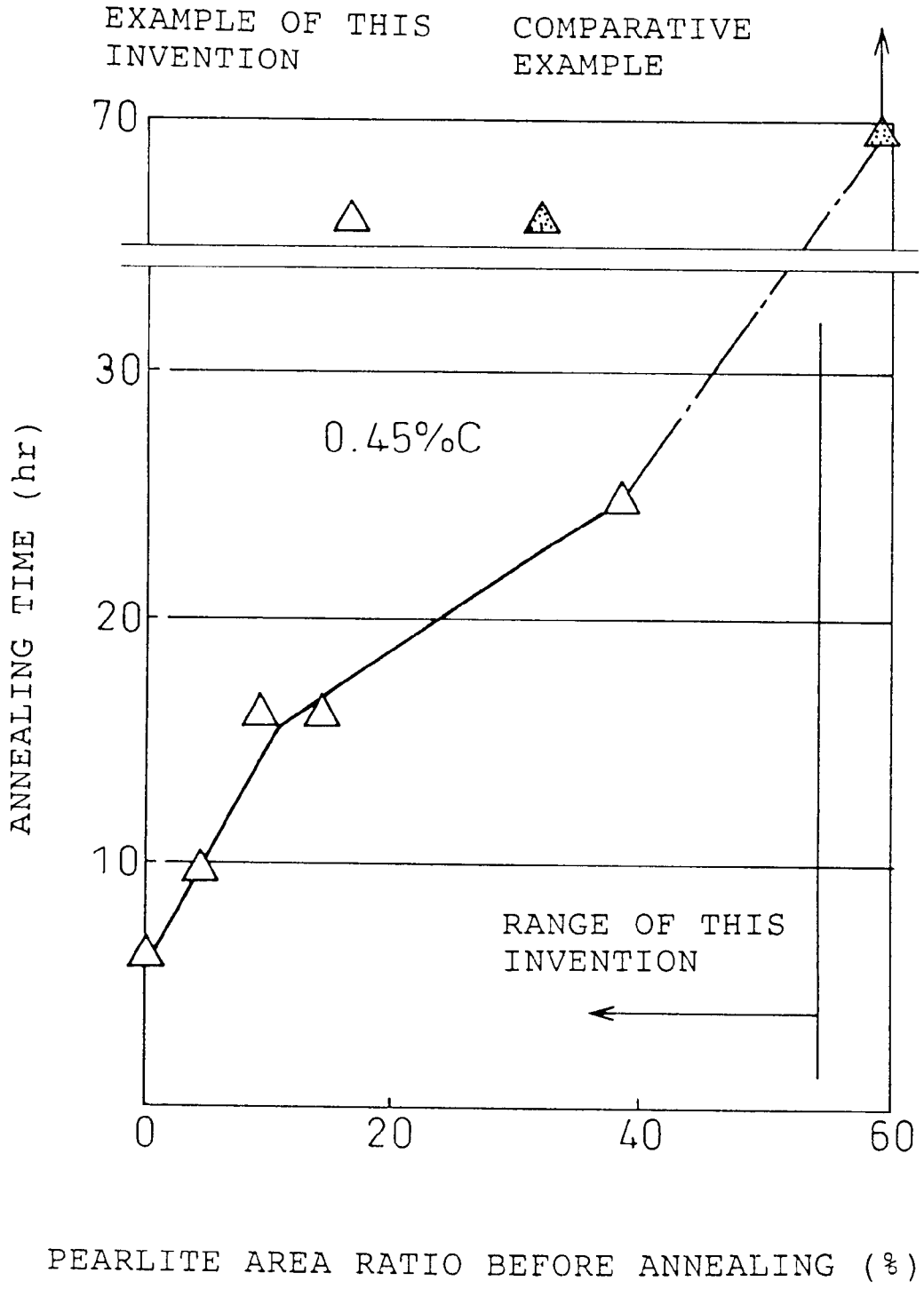
FIG. 4 is a graph showing the relation between the pearlite area ratio and the annealing time until softening in an embodiment of a 0.45% class.
Figure 5:
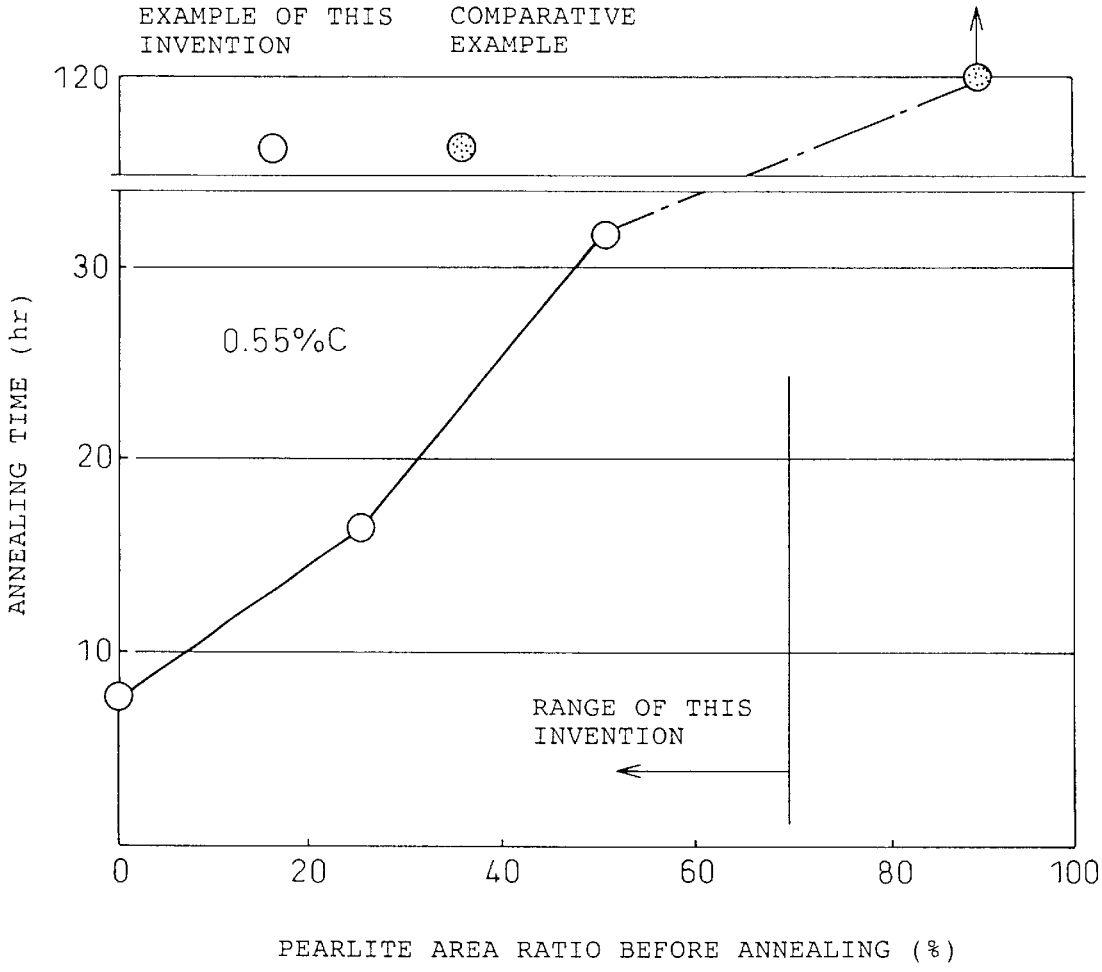
FIG. 5 is a graph showing the relation between the pearlite area ratio and the annealing time until softening in an embodiment of 0.55% class.

Hereinafter, the present invention will be explained in detail.

Initially, the steel structure used for the steel for cold forging according to the present invention, and its contents, will be explained.

At least 0.1% of C (carbon) must be contained in order to secure strength as components after hardening and tempering. The upper limit is set to 1.0% to prevent firing cracking.

Si (silicon) has the function of promoting graphitization by increasing carbon activity in the steel. Its lower limit is preferably at least 0.1% from the aspect of graphitization. If the Si content exceeds 2.0%, problems such as the increase of ferrite hardness and the loss of toughness of the steel become remarkable. Therefore, the upper limit is 2.0%. Si can be used as the element that regulates the graphitization ratio. The smaller its content, the smaller becomes the graphitization ratio after annealing. When the graphitization ratio is lowered by decreasing the Si content, the hardness of the ferrite phase drops. Therefore, the hardness of the steel material does not increase within the range described above, and cold forgeability is not lowered.

Mn (manganese) must be added in the total amount of the amount required for fixing and dispersing S in the steel as MnS and the amount required for securing the strength after hardening by causing Mn to undergo solid solution in the matrix. Its lower limit value is 0.01%. The hardness of the base becomes higher with the increase of the Mn content, and cold formability drops. Mn is also a graphitization-impeding element. When the amount of addition increases, the annealing time is likely to become longer. Therefore, the upper limit is set to 1.50%.

P (phosphorus) increases the hardness of the base metal in the steel and lowers cold formability. Therefore, its upper limit must be 0.1000%.

S (sulfur) exists as MnS inclusions as it combines with Mn. From the aspect of cold formability, its upper limit must be set to 0.500%.

Solid solution nitrogen, that does not exist as nitrides, dissolves in cementite and impedes decomposition of cementite. Therefore, it is a graphitization-impeding element. Therefore, the present invention stipulates N as sol. N. If the sol. N content exceeds 0.005%, the annealing time necessary for graphitization becomes extremely long. Therefore, the upper limit of sol. N is 0.005%. This is because sol. N hinders the diffusion of C, retards graphitization and enhances the ferrite hardness.

Cr (chromium) is a hardenability-improving element and at the same time, a graphitization-impeding element. Therefore, when the improvement of hardenability is required, at least 0.01% of Cr must be added. When added in a large amount, Cr impedes graphitization and prolongs the annealing time. Therefore, the upper limit is 0.70%.

Mo (molybdenum) is the element that increases the strength after hardening, but is likely to form carbides and impedes graphitization. Therefore, the upper limit is set to 0.50% at which the graphitization-impeding effect becomes remarkable, and the Mo content is set to the addition amount that does not greatly impede the formation of the graphite nuclei. In comparison with other hardenability-improving elements, however, the degree of impeding of graphitization by Mo is smaller. For this reason, the Mo addition amount may be increased so as to improve hardenability within the range stipulated above.

Ti (titanium) forms TiN in the steel and reduces the γ grain diameter. Graphite is likely to precipitate at the γ grain boundary and precipitates, or in other words, "non-uniform portions" of the lattice, and carbonitrides of Ti bear the role of the precipitation nuclei of graphite and the role of creation of the graphite precipitation nuclei due to the reduction of the γ grain diameters to fine diameters. Furthermore, Ti fixes N as the nitrides and thus reduces sol. N. If the Ti content is less than 0.01%, its effect is small, and if the Ti content exceeds 0.20%, the effect gets into saturation and at the same time, a large amount of TiN is precipitated and spoil the mechanical properties.

V (vanadium) forms carbonitrides, and shortens the graphitization annealing time from both the aspect of fining of the γ grains and of the precipitation nuclei. It reduces sol. N at the time of the formation of carbonitrides. If the V content is less than 0.05%, its effect is small, and if the V content exceeds 0.50%, the effect gets into saturation and at the same time, large amounts of non-dissolved carbides remain with the result being deterioration of the mechanical properties.

Nb (niobium) forms carbonitrides and shortens the graphitization annealing time from both the aspect of fining of the γ grain diameters to fine diameters and of the precipitation nuclei. It also lowers sol. N at the time of the formation of the nitrides. If the Nb content is less than 0.01%, the effect is small and if it exceeds 0.10%, the effect gets into saturation and at the same time, large amounts of non-dissolved carbides remain with the result being deterioration of the mechanical properties.

Mo (molybdenum) increases the strength after hardening. However, it is the element that is likely to form carbides, lowers carbon activity, and impedes graphitization. Therefore, the upper limit is set to 0.5% at which the graphitization-impeding effect becomes remarkable, and the addition amount is limited to the level at which the graphite nucleus formation is not greatly impeded. Since the degree of the graphitization-impeding effect of Mo is lower than that of other hardenability-improving elements, however, the Mo addition amount may be increased so as to improve hardenability within the range stipulated above.

Zr (zirconium) forms oxides, nitrides, carbides and sulfides, which shorten the graphitization annealing time as the precipitation nuclei. Zr reduces sol. N at the time of the formation of the nitrides. Furthermore, Zr spheroidizes the shapes of the sulfides such as MnS, and can mitigate rolling anisotropy as one of the mechanical properties. Furthermore, Zr can improve hardenability. If the Zr content is less than 0.01%, the effect is small and if it exceeds 0.30%, the effect gets into saturation and at the same time, large amounts of non-dissolved carbides remain with the result being deterioration of the mechanical properties.

At least 0.001% of Al (aluminum) is necessary for deoxidizing the steel and for preventing surface scratches during rolling. The deoxidizing effect gets into saturation when the Al content exceeds 0.050% and the amounts of aluminum type inclusions increase. Therefore, the upper limit is 0.050%. When precipitated as AlN, aluminum plays the role of the precipitation nuclei of graphite and the role of creating the graphite precipitation nuclei due to fining of the y grain diameters to fine diameters. Furthermore, because Al fixes N as the nitrides, it reduces sol. N.

B (boron) reacts with N and precipitates as BN in the austenite crystal grain boundary. It is therefore useful for reducing sol. N. BN has a hexagonal system as its crystal structure in the same way as graphite, and functions as the precipitation nuclei of graphite. Furthermore, sol. B is the element that improves hardenability, and is preferably added when hardenability is required. Its lower limit value must be 0.0001%. The effects of precipitating BN and improving hardenability get into saturation when the B content exceeds 0.0060%. Therefore, the upper limit is 0.0060%.

Pb (lead) is a cuttability-improving element, and at least 0.01% is necessary when cuttability is required. If the Pb content exceeds 0.30%, Pb impedes graphitization and invites problems during production such as rolling scratches. Therefore, the upper limit is 0.30%.

Ca (calcium) is effective when mitigation of rolling anisotropy by spheroidizing of MnS and the improvement of cuttability are required. If the Ca content is less than 0.0001%, the effect is small, and if it exceeds 0.0020%, the precipitates will deteriorate the mechanical properties. Therefore, the upper limit is 0.0020%.

Te (tellurium) is a cuttability-improving element and helps mitigate rolling anisotropy by spheroidizing of MnS. If the Te content is less than 0.001%, the effect is small and if it exceeds 0.100%, problems such as impediment of graphitizing and rolling scratches occur. Therefore, the upper limit is 0.100%.

Se (selenium) is effective for improving cuttability. If the Se content is less than 0.01%, the effect is small, and if it exceeds 0.50%, the effect gets into saturation. Therefore, the upper limit is 0.50%.

Bi (bismuth) is effective for improving cuttability. If the Bi content is less than 0.01%, the effect is small, and if it exceeds 0.50%, the effect gets into saturation. Therefore, the upper limit is 0.50%.

Mg (manganese) is an element that forms oxides such as MgO and also forms sulfides. MgS is co-present with MnS in many cases and such oxides and sulfides function as the graphite precipitation nuclei and are effective for finely dispersing graphite and for shortening the annealing time. If the Mg content is less than 0.0005%, the effect cannot be observed and if it exceeds 0.0200%, Mg forms large amounts of oxides and lowers the strength of the steel. Therefore, the Mg content is limited to the range of 0.0005 to 0.0200%.

Next, the as-rolled steel structure of the steel for cold forging according to the present invention will be explained.

The hardness of the surface layer of the steel for cold forging can be increased by rapidly cooling the steel from a temperature above a transformation point, but is affected by the C content. When the surface layer hardness is too low, the steel cannot be used for the application that requires the surface layer hardness. For example, those steels for which wear resistance is required must have hardness at least higher than the strength of ordinary annealed steel materials. The present invention can provide a steel having hardness of at least 450×(C %)+90 in terms of the Vickers hardness Hv in accordance with the C content.

Next, the reason why the pearlite ratio in the steel structure, that is, (pearlite occupying area ratio in microscope plate/microscope plate), is limited to not greater than 120×(C %) % (with the proviso that the value is not greater than 100%; and hereinafter the same) will be explained. When carbon in the steel is graphitized in the component system of the present invention, cementite is generally formed if the steel is cooled from the austenite region at an atmospheric cooling rate or a rate higher than the former. In order to impart excellent cold formability after annealing, however, carbon (C) must be graphitized by annealing. The graphitization process by annealing is believed to comprise decomposition of cementite→diffusion of C→formation and growth of graphite nuclei. From the viewpoint of the decomposition of cementite, a long time is necessary for the decomposition of cementite if the size of cementite is great and it is stable energy-wise, that is, if C forms pearlite on the lamella. In consequence, the annealing time cannot be shortened.

From the viewpoint of the growth of graphite, graphite at positions having a small diffusion distance for C are likely to be formed and to grow. In other words, graphite is likely to be formed near the positions of previous pearlite. This means that the graphite so formed is coarse and is non-uniformly dispersed. The deformation quantity till breakage after annealing is decreased, decomposition of graphite by radio-frequency hardening and diffusion of C are time-consuming, and hardening properties by radio-frequency hardening are lowered. In this way, in the steel according to the present invention, the formation of pearlite is restricted as much as possible so that the annealing time can be shortened and excellent deformation properties can be imparted after annealing.

Next, the outline of the method of measuring the pearlite ratio is shown in FIG. 1. The calculation method of the pearlite ratio by the pearlite ratio measuring method is made in accordance with the following equation.

$$(P\ \%) = \sum_{i=1}^{n} \{(Pi\ \%) \cdot 2\pi w \cdot ri\}$$

Here, $$ri=(i-1)\cdot w+w/2,\ w=R/n$$

(P%)=pearlite ratio, w: measurement representative width, n: number of splitting (Pi%): pearlite proportion at measurement position, ri: measurement representative radius, i: argument at the time of splitting (I=1, 2, . . . , n) from inside), R: radius of steel bar or wire material.

This method is a simple method. The greater the number of splitting n, the smaller becomes w. Therefore, the pearlite ratio of the steel can be calculated as a correct area ratio.

The present invention stipulates n to ≧5. More concretely, a polished sample for microscope inspection, which is etched in a sectional direction by a nital reagent, is inspected in a 1 mm pitch from the surface layer to the center through a 1,000× optical microscope (n=10 in a 20 mm wire material). The pearlite area ratio inside the visual field is measured by an image processor, and the pearlite area occupying ratio inside the section is calculated using the area ratio as a representative value w of a 1 mm width in the radial direction of the steel bar or the wire material.

In this case, the samples in which the lamella structure can be observed by etching by the nital reagent are defined as pearlite. When this area ratio exceeds 120×(C %) %, the annealing time is extremely extended. The influences on the annealing time vary with the C content of the raw material. However, if the C content is great and the pearlite area occupying ratio is greater than 120×(C %) %, the material cannot be practically used from the aspect of the production cost. Therefore, the upper limit of the pearlite area ratio is limited to 120×(C %) %. However, this value does not exceed 100%.

FIGS. 2 to 5 show the relation between the pearlite area ratio before annealing and the annealing time when the C content is different, respectively. The steel is softened more easily when the C content is smaller, but the annealing time is extremely prolonged outside the range of the present invention, as can be seen from these graphs.

Next, the steel structure of the steel for cold forging according to the present invention, after it is hardened or annealed, will be explained.

The majority of C in the steel exists as cementite or graphite. Graphite can easily undergo deformation because it has cleavages. If the matrix is soft, cold forgeability is excellent. When the steel is cut, cuttability can be improved by the functions of both an internal lubricant and a breaking starting point. If the graphite content is smaller than 20%, the steel cannot exhibit sufficient deformation/lubricating functions. Therefore, the graphite content must exceed 20%. When deformation properties are preferentially required, the graphitization is increased. In order to secure excellent radio-frequency hardenability, on the other hand, it is effective to intentionally leave a part of C without being graphitized and to leave it as cementite.

Furthermore, the present invention stipulates that the mean crystal grain diameter of graphite is not greater than $10\times(C\%)^{1/3}$ μm and the maximum grain diameter is not greater than 20 μm, in consideration of radio-frequency hardenability. In other words, when radio-frequency hardening is conducted, the hardening properties are governed by decomposition/diffusion of C in graphite. In this instance, if the graphite grain diameter is great, a large quantity of energy and much time are necessary for the decomposition/diffusion, and a stable hardened layer cannot be obtained easily by radio-frequency hardening. In order to stably obtain the hardened layer corresponding to the C content contained in the steel by radio-frequency hardening, the process of which can be finished within a short time, the mean grain diameter of graphite must be not greater than $10\times(C\ \%)^{1/3}$ μm. If the mean grain diameter exceeds this limit, the amount of non-dissolved graphite is great even after radio-frequency hardening, or the amount of a mixed structure of a layer containing C in the diffusion process and ferrite that does not yet contain diffused C becomes great. As a result, not only hardening becomes difficult, but a stabilized hardened layer cannot be obtained.

Figure 9:
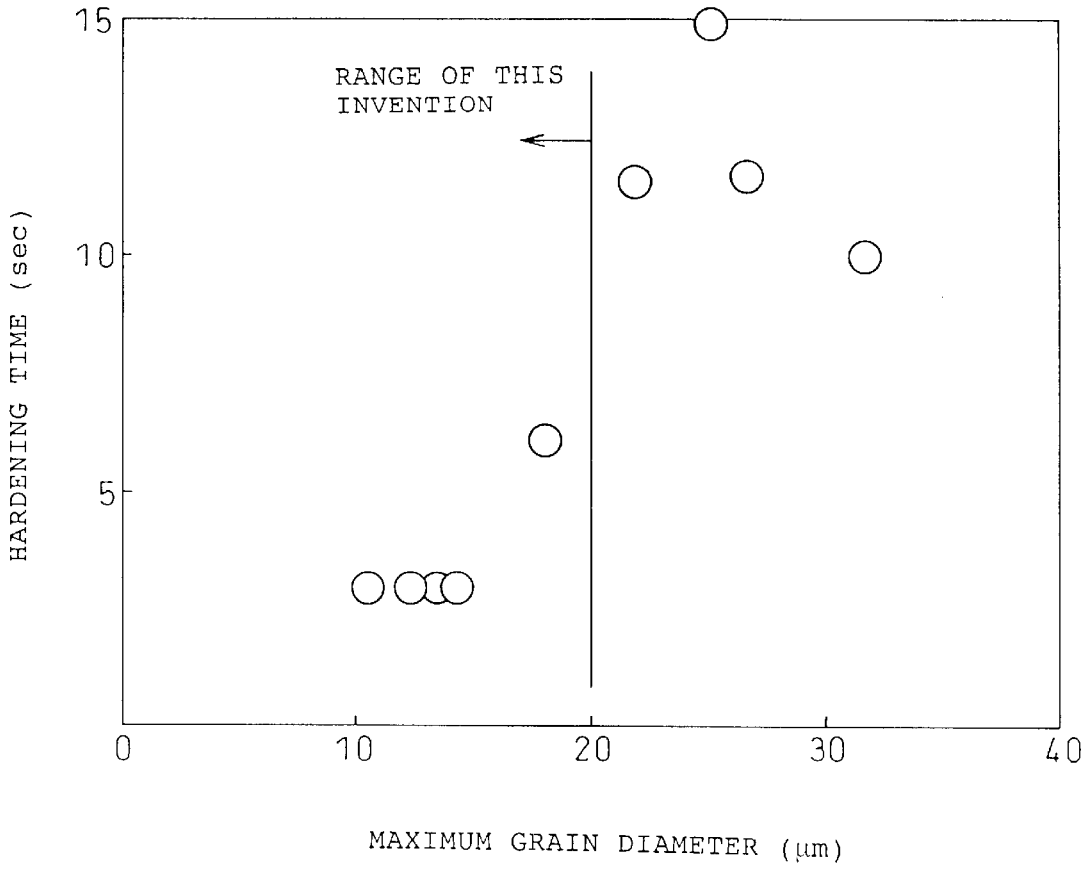
FIG. 9 is a graph showing the relation between a maximum crystal grain diameter and a hardening time by radio-frequency heating in an embodiment of a 0.55% C class.
Figure 10:
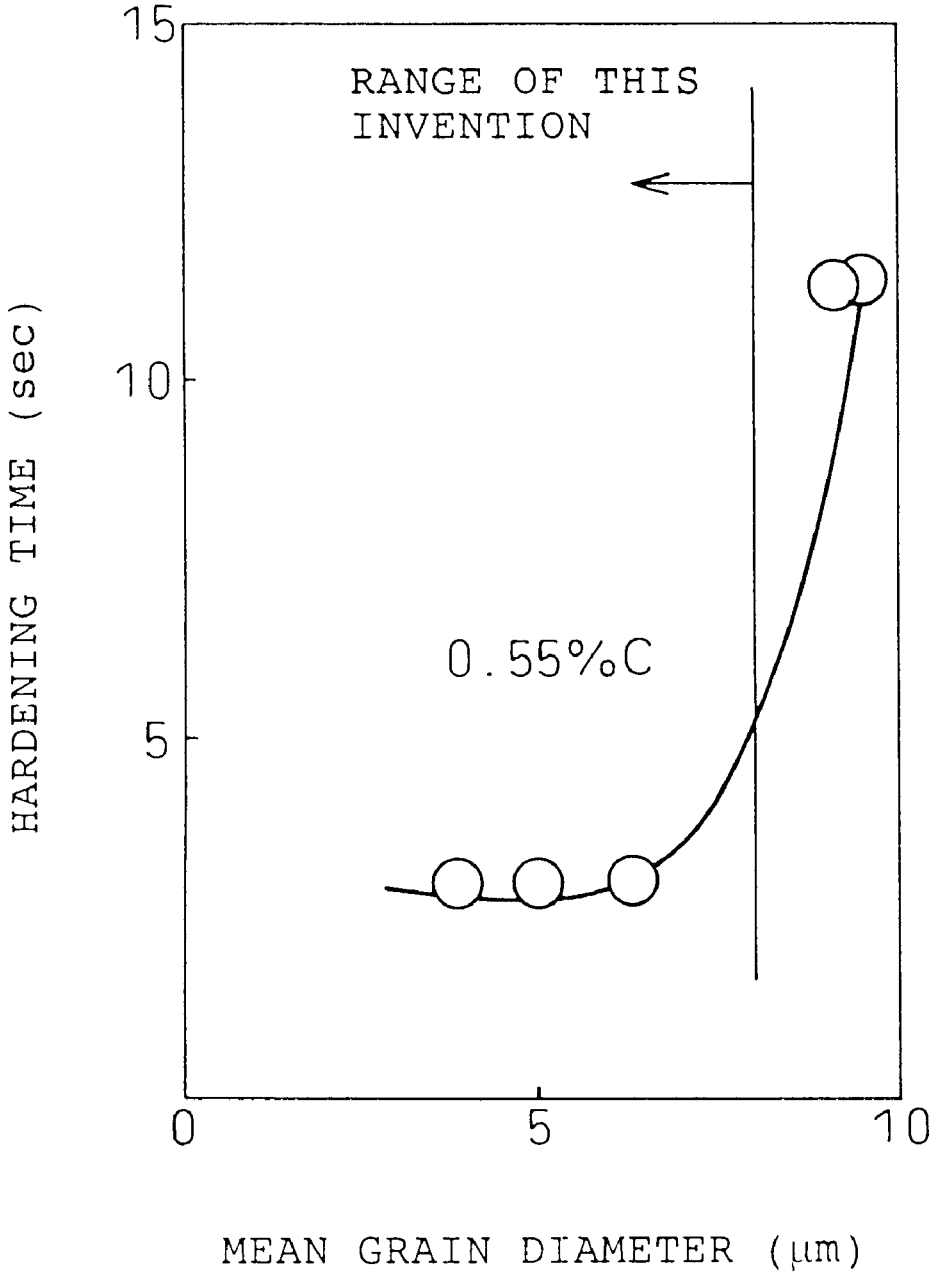
FIG. 10 is a graph showing the relation between a mean crystal grain diameter and the hardening time by radio-frequency heating in an embodiment of the 0.55 C class.
Figure 11:
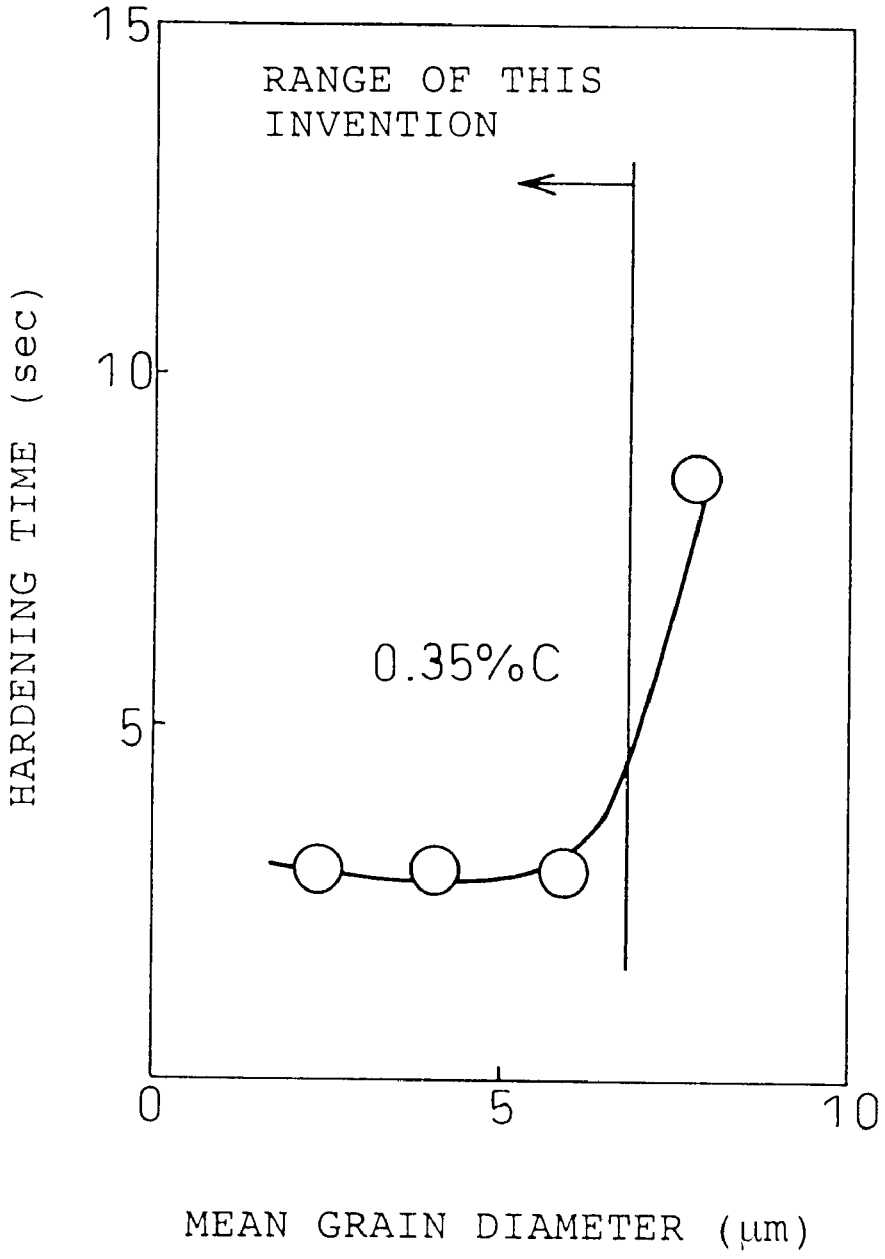
FIG. 11 is a graph showing the relation between the mean crystal grain diameter and the hardening time by radio-frequency heating in an embodiment of the 0.35% C class.

FIGS. 10 and 11 show the relation between the mean grain diameter of graphite and the hardening time by radio-frequency hardening, and FIG. 9 shows the relation between the maximum grain diameter of graphite and the hardening time by radio-frequency hardening.

Next, the production method when the steel for cold forging according to the present invention is used as-rolled will be explained.

After the steel having the steel composition described above is rolled in the austenite temperature range, the formation quantity of pearlite will become great if the cooling rate is low, and the annealing time till softening gets prolonged. Because the surface layer hardness is not sufficient, either, the steel is so soft that it cannot be used directly as such and is too hard for cold forging. To solve these problems, the steel is preferably cooled rapidly. If the cooling rate of the surface layer from the end of rolling to 500° C. is at least 1° C./s, the hardness at the surface layer can be increased in comparison with the hardness of the inside that is gradually cooled. In order to keep the pearlite area ratio on the steel section at 120×(C %) % or below, too, cooling must be carried out at a cooling rate of at least 1° C./s. The austenite amount can be decreased by once cooling the steel, heating it again to the austenitization temperature, and then cooling it by water. However, on-line treatment is more preferred from the aspects of the production cost and the production process.

In connection with the internal structure of the steel, the main object of the present invention is not to increase the hardness by rapid cooling as in the case of ordinary hardening but is to prevent the formation of pearlite so that decomposition easily develops during annealing. For this reason, the cooling capacity need not particularly be increased. In the practical production process of the steel materials, products having diameters of 5 to 150 mm are shipped in most cases, and the present invention may be directed to restrict the formation of pearlite in such products. In other words, the steel structure need not particularly comprise the martensite structure, and even the structure having the bainite structure can shorten the annealing time for softening much more than the steels having the ferrite and pearlite structures. Concrete means pass the steel material immediately after rolling through a cooling apparatus such as a cooling trough or a water tank that is installed at the rearmost part of the rolling line.

In the on-line process, the steel material is passed through the cooling means and is then cooled in the open atmosphere. It is hereby important that even when the surface layer is once cooled, it is heated recuperatively by the heat inside the steel material. It is necessary to limit this recuperative temperature to 650° C. or below.

If the recuperative temperature is higher than 650° C., the surface layer hardness drops, and pearlite is formed at a part of the structure during cooling of the steel material in the open atmosphere. Therefore, it becomes difficult to limit the pearlite amount to 120×(C %) %. The cooling rate and the recuperative properties are greatly affected by the diameters of the rods and the wires that are rolled. Cooling means is not limited to water cooling, and any means capable of achieving the cooling rate of at least 1° C./sec and the recuperative temperature of not higher than 650° C. may be employed, such as oil cooling, air cooling, and so forth.

As described above, the steel material is cooled immediately after rolling by the cooling means mounted to the rolling line, and the recuperative temperature is limited to 650° C. or below. In this way, the surface layer hardness can be increased and the pearlite area occupying ratio can be limited to 120×(C %) % or below.

Figure 6:
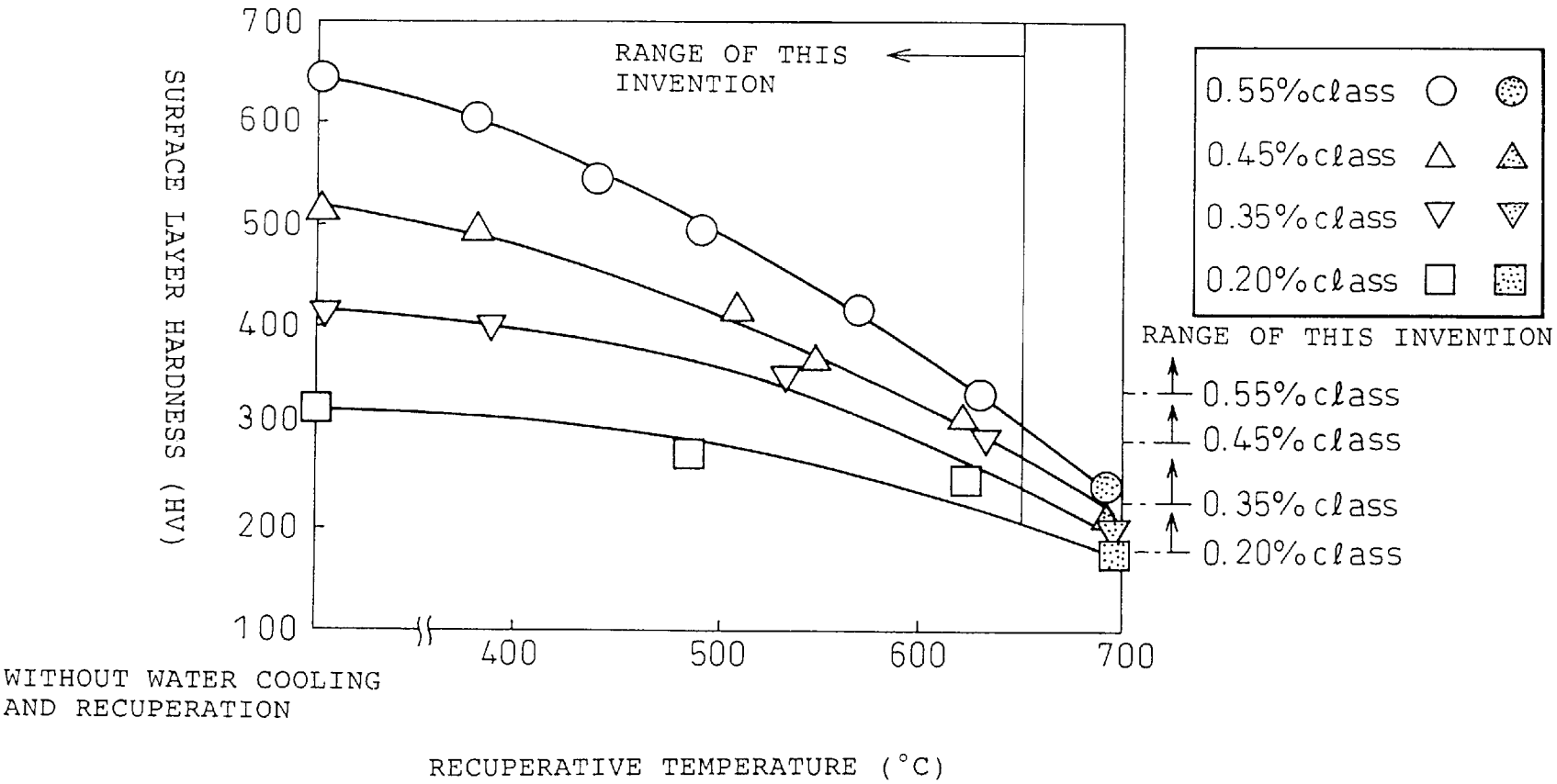
FIG. 6 is a graph showing the relation between a recuperative temperature and a surface layer hardness.
Figure 7:
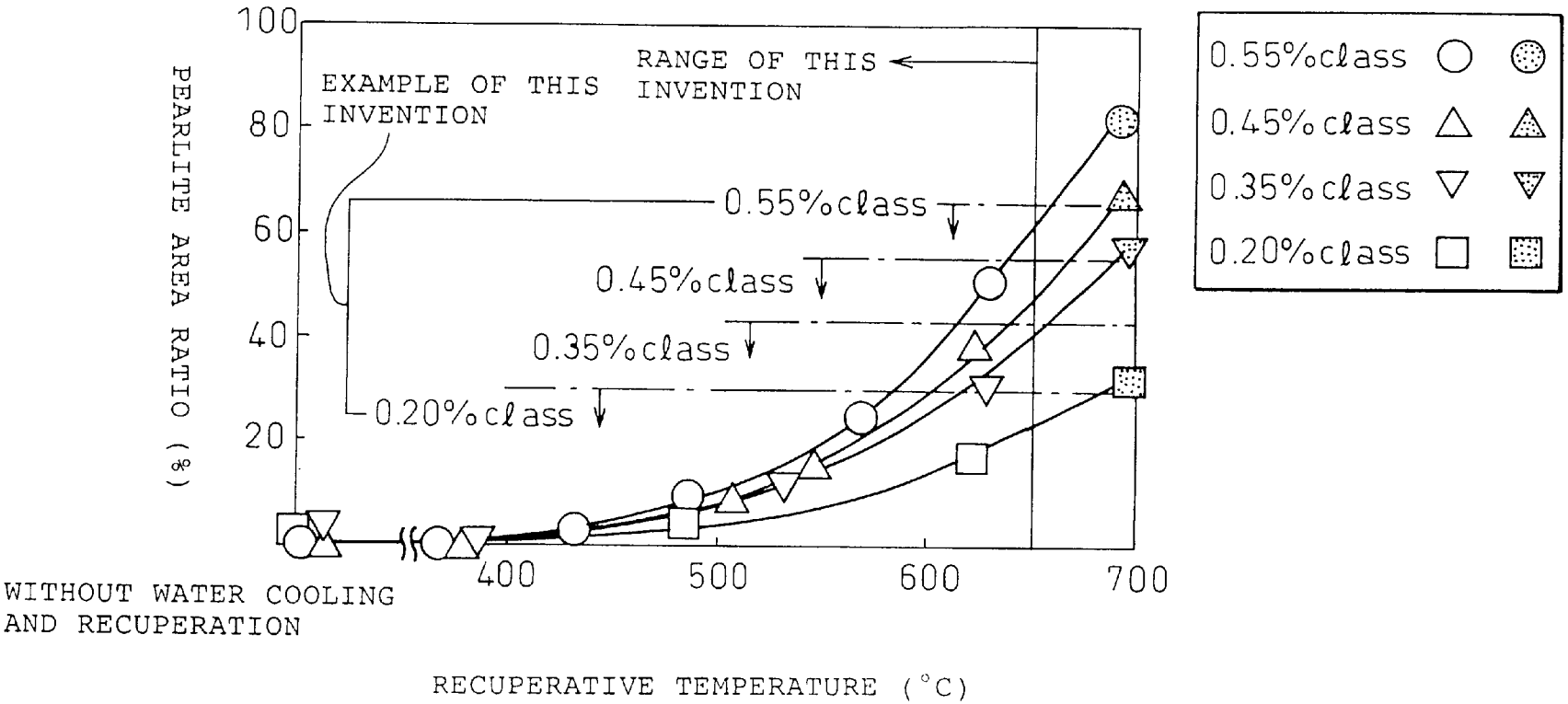
FIG. 7 is a graph showing the relation between the recuperative temperature and the pearlite area ratio.

FIG. 6 shows the relation between the recuperative temperature and the surface layer hardness. As shown in FIG. 6, the surface layer hardness cannot be secured when the recuperative heat becomes high. FIG. 7 shows the relation between the recuperative temperature and the pearlite area ratio. It can be seen from FIG. 7 that the pearlite area ratio increases when the recuperative temperature becomes high. It can be thus appreciated from FIGS. 6 and 7 that restriction of the recuperative temperature after rapid cooling is of importance.

Next, the annealing condition when the steel for cold forging, that is produced in accordance with the present invention and is used for cold forming after annealing, will be explained.

In order to obtain graphite in the amount stipulated by the present invention for using the steel for cold forming, annealing is further necessary. Since graphite is a stable phase of the steels in Fe—C type steels, the steels may be kept at a temperature lower than the transformation temperature A, for a long time. However, since it is practically necessary to precipitate graphite within a limited time, the steels are preferably kept at a temperature within the range of 600 to 710° C. at which graphite precipitates more quickly. In this case, graphitization can be completed within 1 to 50 hours.

When such a condition is employed, the structure, in which the existence ratio of C as graphite in the steel exceeds 20%, the mean grain diameter of graphite is not greater than $10\times(C\ \%)^{1/3}$ $\mu$m and the maximum grain diameter is not greater than 20 $\mu$m, as stipulated in the present invention, can be acquired.

EXAMPLES

Example 1

Steels having the chemical components shown in Tables 1 to 8 were melted. In this example, the steels were rolled into a diameter of 50 mm or 20 mm in the austenite temperature zone and were immediately cooled with water. The rolling temperatures were within the range of 800 to 1,100° C. falling within the austenite temperature zone. Water cooling was conducted using a cooling trough installed at the rearmost part of the rolling line. Some of test specimens inclusive of Comparative Examples were rolled to a diameter of 500 mm or 20 mm at temperatures higher than 1,200° C. and were then cooled by air.

A specimen for optical microscope study was collected from each test steel in the sectional direction and, after being polished into a mirror surface, each specimen was etched using nital. Pearlite was isolated from other structures at a magnification of 1,000×, and the pearlite area ratio was quantitatively determined by an image processor. In this case, the number of visual fields, as the object, was 50.

Such heat-treated materials were annealed at 680° C. To determine the hardness, the hardness was measured every four hours up to the annealing time of 16 hours, every 8 hours up to the annealing time of 48 hours and every 24 hours after the annealing time of longer than 48 hours. The Vickers hardness was determined by the annealing time at which the hardness dropped below HV: 130. As to the temperature, the surface temperatures of the steel materials were measured by a radiation pyrometer. The cooling rate was obtained by dividing the temperature difference between the temperature immediately before cooling and the temperature after recuperation, by the time required for recuperation.

Tables 1 to 6 illustrate examples of the present invention (Nos. 1 to 42) and Tables 7 and 8 show Comparative Examples (Nos. 43 to 62). All of the examples of the present invention had a high surface hardness, and the softening annealing time was short, too. In Comparative Examples 43 to 54, however, the annealing time for softening was prolonged when the sol. N amount was outside the range of the present invention. In Comparative Examples 55 to 59, the pearlite fraction was great because the cooling rate was insufficient, and the annealing time was long. In Comparative Examples 60 to 62, the recuperative temperature was high and the annealing time was long, too. It could be appreciated that the surface layer hardness was insufficient when the cooling rate and the recuperative temperature were outside the respective ranges stipulated by the present invention.

TABLE 1

| | | chemical components | | | | | | | | | | | |
|---|---|---|---|---|---|---|---|---|---|---|---|---|---|
| No. | section | C | Si | Mn | P | S | sol. N | Cr | Ti | V | Nb | Zr | Mo |
| 1 | Example of this invention | 0.51 | 1.23 | 0.32 | 0.023 | 0.017 | 0.0020 | | | | | | |
| 2 | Example of this invention | 0.54 | 1.87 | 0.82 | 0.023 | 0.017 | 0.0021 | | | | | | |
| 3 | Example of this invention | 0.56 | 1.43 | 1.21 | 0.008 | 0.008 | 0.0019 | | | | 0.021 | | |
| 4 | Example of this invention | 0.52 | 1.17 | 0.45 | 0.012 | 0.030 | 0.0042 | 0.20 | | | | | |
| 5 | Example of this invention | 0.51 | 1.23 | 0.32 | 0.023 | 0.017 | 0.0020 | | | 0.11 | | | |

TABLE 1-continued

| No. | section | chemical components | | | | | | | | | | | |
|---|---|---|---|---|---|---|---|---|---|---|---|---|---|
| | | C | Si | Mn | P | S | sol. N | Cr | Ti | V | Nb | Zr | Mo |
| 6 | Example of this invention | 0.54 | 1.87 | 0.82 | 0.023 | 0.017 | 0.0021 | | 0.022 | | | | |
| 7 | Example of this invention | 0.56 | 1.43 | 1.21 | 0.008 | 0.008 | 0.0019 | | 0.023 | | | | |
| 8 | Example of this invention | 0.52 | 1.17 | 0.45 | 0.012 | 0.030 | 0.0042 | | 0.035 | | | | |
| 9 | Example of this invention | 0.51 | 1.16 | 0.45 | 0.027 | 0.028 | 0.0035 | | | | | | 0.12 |
| 10 | Example of this invention | 0.48 | 1.26 | 0.28 | 0.024 | 0.021 | 0.0019 | | | | | | 0.11 |
| 11 | Example of this invention | 0.54 | 1.82 | 0.54 | 0.024 | 0.021 | 0.0029 | | | | | 0.05 | |
| 12 | Example of this invention | 0.48 | 1.26 | 0.36 | 0.029 | 0.018 | 0.0037 | | | | | | |
| 13 | Example of this invention | 0.51 | 1.29 | 0.38 | 0.021 | 0.015 | 0.0032 | | | | | | |
| 14 | Example of this invention | 0.53 | 1.25 | 0.36 | 0.029 | 0.018 | 0.0037 | | | | | | |

TABLE 2

| No. | section | chemical components | | | | | | | | Cooling rate | recuperative temp. | surface layer | pearlite ratio | annealing time | annealing hardness |
|---|---|---|---|---|---|---|---|---|---|---|---|---|---|---|---|
| | | Al | B | Pb | Ca | Te | Se | Bi | Mg | (° C./s) | (° C.) | (HV) | (%) | (hr) | (HV) |
| 1 | Example of this invention | 0.027 | | | | | | | | 15 | 100 | 652 | 0 | 8 | 121 |
| 2 | Example of this invention | 0.023 | | | | | | | | 8 | 489 | 429 | 0 | 8 | 124 |
| 3 | Example of this invention | 0.017 | | | | | | | | 3 | 520 | 364 | 25 | 16 | 127 |
| 4 | Example of this invention | | | | | | | | | 10 | 560 | 410 | 23 | 16 | 126 |
| 5 | Example of this invention | 0.027 | | | | | | | | 3 | 510 | 319 | 12 | 8 | 121 |
| 6 | Example of this invention | 0.023 | | | | | | | | 15 | 380 | 621 | 0 | 8 | 124 |
| 7 | Example of this invention | 0.017 | | | | | | | | 8 | 490 | 510 | 11 | 8 | 127 |
| 8 | Example of this invention | | | | | | | | | 8 | 420 | 565 | 7 | 8 | 126 |
| 9 | Example of this invention | 0.022 | | | | | | | | 8 | 380 | 589 | 0 | 8 | 119 |
| 10 | Example of this invention | 0.034 | 0.0021 | | | | | | | 5 | 510 | 405 | 10 | 16 | 126 |
| 11 | Example of this invention | 0.029 | | 0.13 | | | | | | 5 | 410 | 425 | 32 | 16 | 127 |
| 12 | Exampleof this invention | 0.027 | 0.0021 | | 0.0013 | | | | | 10 | 530 | 385 | 15 | 16 | 124 |
| 13 | Example of this invention | 0.021 | 0.0025 | | | 0.031 | | | | 10 | 550 | 398 | 35 | 8 | 125 |
| 14 | Example of this invention | 0.023 | 0.0024 | | | | 0.23 | | | 15 | 620 | 320 | 53 | 32 | 120 |

TABLE 3

| No. | section | chemical components | | | | | | | | | | | |
|---|---|---|---|---|---|---|---|---|---|---|---|---|---|
| | | C | Si | Mn | P | S | sol. N | Cr | Ti | V | Nb | Zr | Mo |
| 15 | Example of this invention | 0.32 | 1.23 | 0.42 | 0.013 | 0.027 | 0.0021 | | | | | | |
| 16 | Example of this invention | 0.32 | 1.27 | 0.54 | 0.023 | 0.012 | 0.0022 | | | | | | |
| 17 | Example of this invention | 0.26 | 1.83 | 0.51 | 0.003 | 0.015 | 0.0037 | | | | | | |

TABLE 3-continued

| No. | section | chemical components | | | | | | | | | | | |
|---|---|---|---|---|---|---|---|---|---|---|---|---|---|
| | | C | Si | Mn | P | S | sol. N | Cr | Ti | V | Nb | Zr | Mo |
| 18 | Example of this invention | 0.32 | 1.17 | 0.45 | 0.020 | 0.025 | 0.0012 | | | | | | |
| 19 | Example of this invention | 0.25 | 1.20 | 0.60 | 0.026 | 0.020 | 0.0042 | 0.21 | | | | | |
| 20 | Example of this invention | 0.34 | 1.32 | 0.25 | 0.022 | 0.025 | 0.0032 | 0.25 | 0.022 | | | | |
| 21 | Example of this invention | 0.35 | 1.21 | 0.36 | 0.019 | 0.022 | 0.0022 | | 0.023 | | | | |
| 22 | Example of this invention | 0.35 | 1.19 | 0.81 | 0.027 | 0.023 | 0.0038 | | 0.035 | 0.25 | | | |
| 23 | Example of this invention | 0.23 | 1.16 | 0.52 | 0.028 | 0.023 | 0.0045 | | | | 0.040 | | |
| 24 | Example of this invention | 0.35 | 1.26 | 0.55 | 0.027 | 0.019 | 0.0025 | | | | | 0.048 | |
| 25 | Example of this invention | 0.31 | 1.26 | 0.75 | 0.028 | 0.025 | 0.0033 | | | | | | 0.22 |
| 26 | Example of this invention | 0.38 | 1.46 | 0.18 | 0.025 | 0.029 | 0.0015 | | | | | | 0.10 |
| 27 | Example of this invention | 0.32 | 1.31 | 0.91 | 0.030 | 0.022 | 0.0042 | | | | | | |
| 28 | Example of this invention | 0.32 | 1.20 | 0.34 | 0.021 | 0.026 | 0.0042 | | | | | | |
| 29 | Example of this invention | 0.33 | 1.26 | 0.36 | 0.028 | 0.018 | 0.0037 | | | | | | |
| 30 | Example of this invention | 0.38 | 1.34 | 0.45 | 0.029 | 0.017 | 0.0026 | | | | | | |

TABLE 4

| No. | section | chemical components | | | | | | | | Cooling rate | recuperative temp. | surface layer | pearlite ratio | annealing time | annealing hardness |
|---|---|---|---|---|---|---|---|---|---|---|---|---|---|---|---|
| | | Al | B | Pb | Ca | Te | Se | Bi | Mg | (° C./s) | (° C.) | (HV) | (%) | (hr) | (HV) |
| 15 | Example of this invention | 0.025 | | | | | | | | 15 | 100 | 652 | 32 | 4 | 119 |
| 16 | Example of this invention | 0.022 | | | | | | | | 3 | 390 | 385 | 12 | 4 | 125 |
| 17 | Example of this invention | 0.022 | | | | | | | | 3 | 280 | 275 | 19 | 12 | 124 |
| 18 | Example of this invention | | | | | | | | | 15 | 100 | 398 | 0 | 4 | 122 |
| 19 | Example of this invention | 0.021 | | | | | | | | 15 | 100 | 310 | 0 | 4 | 128 |
| 20 | Example of this invention | 0.018 | | | | | | | | 8 | 330 | 416 | 0 | 4 | 124 |
| 21 | Example of this invention | 0.030 | | | | | | | | 3 | 390 | 402 | 2 | 4 | 118 |
| 22 | Example of this invention | 0.031 | | | | | | | | 3 | 360 | 420 | 0 | 4 | 125 |
| 23 | Example of this invention | 0.029 | | | | | | | | 3 | 480 | 295 | 5 | 4 | 126 |
| 24 | Example of this inventionn | 0.027 | | | | | | | | 3 | 530 | 361 | 10 | 8 | 119 |
| 25 | Example of this invention | 0.017 | | | | | | | | 3 | 480 | 311 | 9 | 8 | 120 |
| 26 | Example of this invention | 0.023 | 0.0028 | | | | | | | 3 | 390 | 451 | 0 | 8 | 118 |
| 27 | Example of this invention | 0.026 | 0.0025 | | | 0.021 | | | | 3 | 470 | 338 | 17 | 8 | 131 |
| 28 | Example of this invention | 0.022 | 0.0022 | | 0.0016 | | | | | 3 | 610 | 306 | 25 | 16 | 125 |
| 29 | Example of this invention | 0.022 | 0.0023 | | | | 0.25 | | | 3 | 500 | 318 | 17 | 8 | 109 |
| 30 | Example of this invention | 0.025 | | | | | | | | 3 | 510 | 298 | 20 | 8 | 121 |

TABLE 5

| No. | section | chemical components | | | | | | | | | | | |
|---|---|---|---|---|---|---|---|---|---|---|---|---|---|
| | | C | Si | Mn | P | S | sol. N | Cr | Ti | V | Nb | Zr | Mo |
| 31 | Example of this invention | 0.55 | 0.75 | 0.31 | 0.023 | 0.017 | 0.0020 | | | | | | |
| 32 | Example of this invention | 0.44 | 0.65 | 0.72 | 0.023 | 0.017 | 0.0021 | | | | | | |
| 33 | Example of this invention | 0.36 | 0.50 | 1.01 | 0.008 | 0.008 | 0.0019 | | | | | | |
| 34 | Example of this invention | 0.22 | 0.42 | 0.52 | 0.012 | 0.030 | 0.0042 | | | | | | |
| 35 | Example of this invention | 0.54 | 0.46 | 0.42 | 0.021 | 0.019 | 0.0022 | 0.25 | | | | | |
| 36 | Example of this invention | 0.54 | 0.21 | 0.51 | 0.024 | 0.021 | 0.0042 | 0.21 | 0.021 | | | | |
| 37 | Example of this invention | 0.55 | 0.55 | 0.36 | 0.022 | 0.024 | 0.0022 | | 0.025 | | | | |
| 38 | Example of this invention | 0.48 | 0.64 | 0.24 | 0.024 | 0.021 | 0.0048 | | 0.025 | 0.21 | | | |
| 39 | Example of this invention | 0.52 | 0.43 | 0.37 | 0.022 | 0.022 | 0.0035 | | | | 0.031 | | |
| 40 | Example of this invention | 0.65 | 0.51 | 0.38 | 0.017 | 0.012 | 0.0025 | | | | | 0.053 | |
| 41 | Example of this invention | 0.51 | 0.35 | 0.48 | 0.027 | 0.028 | 0.0035 | | | | | | 0.12 |
| 42 | Example of this invention | 0.48 | 0.65 | 0.19 | 0.024 | 0.021 | 0.0019 | | | | | | 0.11 |

TABLE 6

| No. | section | chemical components | | | | | | | | Cooling rate | recuperative temp. | surface layer | pearlite ratio | annealing time | annealing hardness |
|---|---|---|---|---|---|---|---|---|---|---|---|---|---|---|---|
| | | Al | B | Pb | Ca | Te | Se | Bi | Mg | (° C./s) | (° C.) | (HV) | (%) | (hr) | (HV) |
| 31 | Example of this invention | 0.027 | | | | | | | | 10 | 430 | 521 | 0 | 8 | 121 |
| 32 | Example of this invention | 0.023 | | | | | | | | 15 | 100 | 521 | 0 | 8 | 124 |
| 33 | Example of this invention | 0.017 | | | | | | | | 3 | 500 | 320 | 0 | 4 | 127 |
| 34 | Example of this invention | | | | | | | | | 3 | 380 | 325 | 0 | 8 | 126 |
| 35 | Example of this invention | 0.029 | | | | | | | | 10 | 370 | 596 | 0 | 12 | 125 |
| 36 | Example of this invention | 0.019 | 0.0021 | | | | | | | 10 | 440 | 562 | 36 | 16 | 122 |
| 37 | Example of this invention | 0.029 | | | | | | | | 8 | 430 | 545 | 37 | 12 | 120 |
| 38 | Example of this invention | 0.030 | 0.0021 | | | | | | | 3 | 550 | 320 | 42 | 24 | 128 |
| 39 | Example of this invention | 0.036 | 0.0025 | | | | | | | 3 | 560 | 410 | 45 | 16 | 124 |
| 40 | Example of this invention | 0.021 | 0.0024 | | | | | | | 8 | 440 | 495 | 35 | 16 | 126 |
| 41 | Example of this invention | 0.022 | | | | | | | | 3 | 470 | 452 | 31 | 16 | 119 |
| 42 | Example of this invention | 0.034 | | | | | | | | 8 | 390 | 495 | 2 | 12 | 126 |

TABLE 7

| No. | section | chemical components | | | | | | | | | | | |
|---|---|---|---|---|---|---|---|---|---|---|---|---|---|
| | | C | Si | Mn | P | S | sol. N | Cr | Ti | V | Nb | Zr | Mo |
| 43 | Comparative Example | 0.55 | 1.23 | 0.34 | 0.019 | 0.017 | 0.0059 | | | | | | |
| 44 | Comparative Example | 0.49 | 1.19 | 0.40 | 0.021 | 0.020 | 0.0070 | | | | | | |

TABLE 7-continued

| No. | section | chemical components | | | | | | | | | | | |
|---|---|---|---|---|---|---|---|---|---|---|---|---|---|
| | | C | Si | Mn | P | S | sol. N | Cr | Ti | V | Nb | Zr | Mo |
| 45 | Comparative Example | 0.35 | 1.18 | 0.35 | 0.021 | 0.026 | 0.0062 | | | | | | |
| 46 | Comparative Example | 0.53 | 0.75 | 0.41 | 0.029 | 0.027 | 0.0057 | | | | | | |
| 47 | Comparative Example | 0.46 | 0.69 | 0.41 | 0.022 | 0.021 | 0.0061 | | | | | | |
| 48 | Comparative Example | 0.36 | 0.72 | 0.34 | 0.024 | 0.021 | 0.0057 | | | | | | |
| 49 | Comparative Example | 0.58 | 1.28 | 0.50 | 0.021 | 0.026 | 0.0082 | | 0.01 | | | | |
| 50 | Comparative Example | 0.46 | 0.73 | 0.34 | 0.023 | 0.019 | 0.0059 | | | | | | |
| 51 | Comparative Example | 0.36 | 0.72 | 0.34 | 0.024 | 0.021 | 0.0057 | | | | | | |
| 52 | Comparative Example | 0.58 | 1.21 | 0.32 | 0.024 | 0.026 | 0.0068 | | | 0.11 | | | |
| 53 | Comparative Example | 0.48 | 1.06 | 0.35 | 0.021 | 0.022 | 0.0063 | | | | 0.014 | | |
| 54 | Comparative Example | 0.48 | 0.71 | 0.50 | 0.029 | 0.021 | 0.0065 | | | | | | |
| 55 | Comparative Example | 0.53 | 1.12 | 0.36 | 0.022 | 0.027 | 0.0035 | | | | | | |
| 56 | Comparative Example | 0.51 | 1.21 | 0.35 | 0.019 | 0.019 | 0.0038 | | | | | | |
| 57 | Comparative Example | 0.54 | 1.87 | 0.82 | 0.023 | 0.017 | 0.0021 | | | | | | |
| 58 | Comparative Example | 0.46 | 1.43 | 1.21 | 0.008 | 0.008 | 0.0019 | | | | 0.021 | | |
| 59 | Comparative Example | 0.35 | 1.23 | 0.42 | 0.021 | 0.016 | 0.0045 | | | | | | |
| 60 | Comparative Example | 0.22 | 1.17 | 0.45 | 0.012 | 0.030 | 0.0042 | 0.20 | | | | | |
| 61 | Comparative Example | 0.51 | 1.23 | 0.32 | 0.023 | 0.017 | 0.0020 | | | | | | |
| 62 | Comparative Example | 0.54 | 1.87 | 0.82 | 0.023 | 0.017 | 0.0021 | | 0.022 | | | | |

TABLE 8

| No. | section | chemical components | | | | | | | | Cooling rate | recuperative temp. | surface layer | pearlite ratio | annealing time | annealing hardness |
|---|---|---|---|---|---|---|---|---|---|---|---|---|---|---|---|
| | | Al | B | Pb | Ca | Te | Se | Bi | Mg | (° C./s) | (° C.) | (HV) | (%) | (hr) | (HV) |
| 43 | Example of Example | 0.028 | | | | | | | | 10 | 450 | 586 | 0 | 120 | 138 |
| 44 | Comparative Example | 0.019 | 0.0026 | | | | | | | 10 | 550 | 546 | 0 | 120 | 141 |
| 45 | Comparative Example | 0.021 | | | | | | | | 6 | 560 | 405 | 10 | 120 | 145 |
| 46 | Comparative Example | 0.028 | | | | | | | | 8 | 540 | 486 | 10 | 120 | 145 |
| 47 | Comparative Example | 0.019 | | | | | | | | 8 | 500 | 456 | 40 | 120 | 141 |
| 48 | Comparative Example | 0.021 | 0.0024 | | | | | | | 10 | 450 | 385 | 55 | 120 | 135 |
| 49 | Comparative Example | 0.010 | | | | | | | | 10 | 450 | 367 | 25 | 120 | 150 |
| 50 | Comparative Example | 0.019 | | | | | | | | 10 | 570 | 341 | 20 | 120 | 141 |
| 51 | Comparative Example | 0.021 | 0.0024 | | | | | | | 10 | 570 | 345 | 15 | 120 | 135 |
| 52 | Comparative Example | 0.015 | | | | | | | | 10 | 400 | 520 | 0 | 120 | 152 |
| 53 | Comparative Example | 0.027 | 0.0021 | | | | | | | 10 | 420 | 512 | 0 | 120 | 148 |
| 54 | Comparative Example | 0.021 | 0.0021 | | | | | | | 10 | 440 | 465 | 16 | 32 | 148 |
| 55 | Comparative Example | 0.028 | 0.0025 | | | | | | | 0.5 | 770 | 265 | 86 | 48 | 125 |

TABLE 8-continued

| No. | section | chemical components Al | B | Pb | Ca | Te | Se | Bi | Mg | Cooling rate (° C./s) | recuperative temp. (° C.) | surface layer (HV) | pearlite ratio (%) | annealing time (hr) | annealing hardness (HV) |
|---|---|---|---|---|---|---|---|---|---|---|---|---|---|---|---|
| 56 | Comparative Example | 0.027 | 0.0028 | | | | | | | 0.5 | 700 | 253 | 90 | 32 | 126 |
| 57 | Comparative Example | 0.023 | | | | | | | | 0.5 | 780 | 243 | 82 | 120 | 124 |
| 58 | Comparative Example | 0.017 | | | | | | | | 0.5 | 760 | 225 | 75 | 70 | 127 |
| 59 | Comparative Example | 0.024 | | | | | | | | 0.5 | 770 | 205 | 36 | 48 | 124 |
| 60 | Comparative Example | | | | | | | | | 2 | 780 | 211 | 36 | 120 | 126 |
| 61 | Comparative Example | 0.027 | | | | | | | | 2 | 750 | 254 | 92 | 72 | 151 |
| 62 | Comparative Example | 0.023 | | | | | | | | 2 | 720 | 259 | 81 | 96 | 164 |

Example 2

Steels having the chemical components shown in Tables 9 to 16 were melted, and were rolled into a diameter of 50 mm or 30 mm at 750 to 850° C. Some of the test specimens inclusive of Comparative Examples were forged at a temperature above 1,200° C. Rolled materials, as examples of the present invention, were cooled with water by an on-line water cooling apparatus from 800 to 900° C. immediately after rolling. The forged materials were heated to 850° C. by a heating furnace. The examples of the present invention were cooled by water while the Comparative Examples were cooled by air or water. When air cooling was conducted, the grain diameter of graphite became great. The size of the test specimens in this case was 30 mm in diameter and 40 mm in length. After cooling, the heat-treated materials were heated again to 680° C. and annealed. The graphitization ratio was measured in accordance with JIS G 1211.

The polished samples were prepared, and the graphite grain diameter was measured in the number of 50 visual fields and in magnification of at least 400 times by an image processor. After graphitization annealing, a measurement of the hardness, a cutting test and a radio-frequency hardening test were conducted. The cutting test was carried out by boring using a high-speed steel drill having a diameter of 3 mmϕ. This test was done while the cutting speed was changed, and the drill peripheral speed at which the tool life of at least 1,000 mm, or so-called VL 1,000 (m/min), was reached, and this value was used as the index. This was wet cutting using a water-soluble oil at a feed quantity of 0.33 mm/rev.

The results are shown in Tables 17 to 19.

These tables show the hardness before and after annealing and the hardening time by radio-frequency hardening. The examples of the present invention (Nos. 1 to 59) had a hardness around HV: 120 before annealing and could be hardened to around HV: 600 after annealing. Hardenability by radio-frequency hardening was evaluated by a transformation point automatic measuring equipment ("Formaster"). When heating to 1,000° C. and rapid cooling were conducted by the Formaster, variance occurred in the hardness after radio-frequency annealing because graphite had a slow diffusion time. Therefore, the time before this variance of the hardness due to hardening disappeared was measured by changing the heating time and conducting rapid cooling, and hardenability was evaluated by this time. The size of each test specimen was 3 mm in diameter and 10 mm in length. Here, the variance of hardness was regarded as having disappeared when the variance of hardness of five test specimens fell below HV: 200.

The steels of the examples of the present invention could be softened sufficiently within the short annealing time, and had excellent machinability. Since machinability VL1,000= 150 m/min was the limit of the tester, the steels had the possibility of further improvement. Though soft, they were hardened without variance by radio-frequency annealing. The annealing time was 3 seconds, and the steels could be annealed sufficiently by radio-frequency annealing without variance in the shortest time that could be controlled by the Formaster tester. These tendencies did not change fundamentally even when elements such as Ti and Cr were added, and these elements could be added whenever machinability and hardenability were further required.

Figure 8:
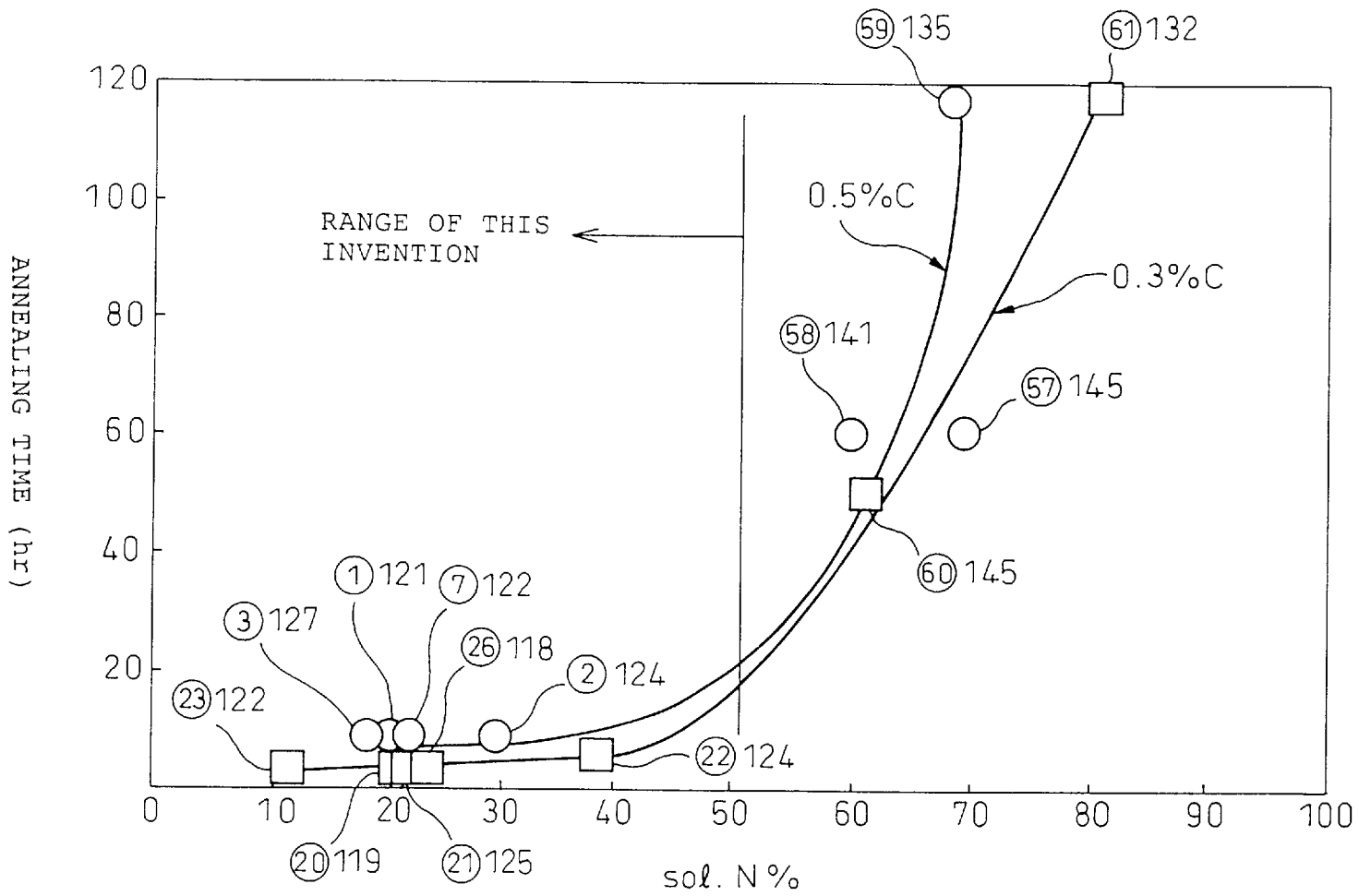
FIG. 8 is a graph showing the relation between solid solution nitrogen and the annealing time until softening.

Comparative Examples Nos. 57 to 70 were test specimens the N content of which exceeded the range of the present invention, and the graphite grain diameter of which exceeded the range of the present invention. In order to further clarify the effect of sol. N, FIG. 8 shows the influences of sol. N on the graphite annealing time and the hardness. Numerals in circles in FIG. 8 represent the Example No., and the hardness obtained thereby is added.

The annealing time necessary for achieving HV: 120 or below could be remarkably shortened when sol. N was decreased. Generally, the hardness of the steel materials was affected by the C content, and the influence of ferrite hardness became remarkable when graphite was formed. When large amounts of sol. N were contained, the hardness was not lowered sufficiently at any C contents even when the annealing time was extended up to 120 hours. It could be appreciated also that that even when the total N content was at the same level, the annealing time changed greatly depending on the sol. N amount (Examples Nos. 7 and 26 and Comparative Examples Nos. 57 and 60).

Minimum hardness could be lowered by lowering sol. N. The steels having such a lowered amount of sol. N could be made softer than the steels having a large sol. N content. It could be thus appreciated that when the sol. N amount exceeded the limit of the present invention, the annealing time became long, though there are certain differences in the addition elements. When annealing was cut halfway as in Comparative Examples Nos. 65 to 67, the graphitization ratio became insufficient, so that the hardness after annealing did not lower and cold forgeability became inferior. When the hardness was high, cuttability fell, as well. Even if a process that was economically disadvantageous was conducted by extending the annealing time, variance of the hardness was likely to occur in radio-frequency hardening unless the graphite grain diameter was small enough to fall within the range of the present invention.

Since the maximum grain diameter was great and diffusion of C by radio-frequency hardening was difficult in Comparative Examples Nos. 68 to 71, a long heating time was necessary for obtaining a uniform hardness.

As could be seen from Comparative Examples 71 to 73, the radio-frequency annealing heating time had to be extended so as to eliminate the variance when the mean grain diameter was great. This became the same as overall heating by radio-frequency heating. In consequence, control of the thickness of the hardened layer became difficult, and firing cracks were likely to occur.

TABLE 9

| | | chemical components | | | | | | | | | | | | |
|---|---|---|---|---|---|---|---|---|---|---|---|---|---|---|
| No. | section | C | Si | Mn | P | S | sol. N | total N | Cr | Ti | V | Nb | Zr | Mo |
| 1 | Example of this invention | 0.51 | 1.23 | 0.32 | 0.023 | 0.017 | 0.0020 | 0.0025 | | | | | | |
| 2 | Example of this invention | 0.54 | 1.87 | 0.82 | 0.023 | 0.017 | 0.0029 | 0.0035 | | | | | | |
| 3 | Example of this invention | 0.56 | 1.43 | 1.21 | 0.008 | 0.008 | 0.0019 | 0.0026 | | | | | | |
| 4 | Example of this invention | 0.52 | 1.17 | 0.45 | 0.012 | 0.030 | 0.0032 | 0.0036 | | | | | | |
| 5 | Example of this invention | 0.54 | 1.20 | 0.30 | 0.021 | 0.019 | 0.0022 | 0.0042 | 0.25 | | | | | |
| 6 | Example of this invention | 0.54 | 1.22 | 0.35 | 0.024 | 0.021 | 0.0018 | 0.0052 | 0.21 | 0.021 | | | | |
| 7 | Example of this invention | 0.55 | 1.21 | 0.32 | 0.022 | 0.024 | 0.0022 | 0.0062 | | 0.015 | | | | |
| 8 | Example of this invention | 0.55 | 1.19 | 0.41 | 0.024 | 0.021 | 0.0038 | 0.0068 | | 0.025 | 0.21 | | | |
| 9 | Example of this invention | 0.52 | 1.16 | 0.50 | 0.022 | 0.022 | 0.0035 | 0.0055 | | | | 0.031 | | |
| 10 | Example of this invention | 0.65 | 1.26 | 0.35 | 0.017 | 0.012 | 0.0025 | 0.0057 | | | | | 0.053 | |
| 11 | Example of this invention | 0.51 | 1.16 | 0.45 | 0.027 | 0.028 | 0.0035 | 0.0045 | | | | | | 0.12 |
| 12 | Example of this invention | 0.48 | 1.26 | 0.28 | 0.024 | 0.021 | 0.0019 | 0.0047 | | | | | | 0.11 |
| 13 | Example of this invention | 0.54 | 1.82 | 0.54 | 0.024 | 0.021 | 0.0029 | 0.0032 | | | | | | |
| 14 | Example of this invention | 0.52 | 1.09 | 0.36 | 0.029 | 0.018 | 0.0037 | 0.0055 | | | | | | |
| 15 | Example of this invention | 0.51 | 1.29 | 0.38 | 0.021 | 0.015 | 0.0032 | 0.0050 | | | | | | |
| 16 | Example of this invention | 0.53 | 1.25 | 0.36 | 0.029 | 0.018 | 0.0037 | 0.0047 | | | | | | |
| 17 | Example of this invention | 0.54 | 1.31 | 0.46 | 0.027 | 0.012 | 0.0017 | 0.0026 | | | | | | |
| 18 | Example of this invention | 0.54 | 1.31 | 0.46 | 0.027 | 0.012 | 0.0017 | 0.0036 | | | | | | |
| 19 | Example of this invention | 0.52 | 1.20 | 0.32 | 0.015 | 0.010 | 0.0027 | 0.0060 | | | | | | |

TABLE 10

| | | chemical components | | | | | | | | graphitization ratio | mean grain | | maximum grain |
|---|---|---|---|---|---|---|---|---|---|---|---|---|---|
| No. | section | Al | B | Pb | Ca | Te | Se | Bi | Mg | (%) | diameter | $10 \times C^{1/3}$ | diameter |
| 1 | Example of this invention | 0.027 | | | | | | | | 79 | 4.2 | 7.99 | 13.2 |
| 2 | Example of this invention | 0.023 | | | | | | | | 85 | 4.5 | 8.14 | 11.5 |
| 3 | Example of this invention | 0.017 | | | | | | | | 82 | 5.5 | 8.24 | 10.6 |
| 4 | Example this invention | | | | | | | | | 82 | 4.8 | 8.04 | 14.2 |
| 5 | Example of this invention | 0.029 | | | | | | | | 72 | 4.2 | 8.14 | 12.6 |

TABLE 10-continued

| No. | section | chemical components Al | B | Pb | Ca | Te | Se | Bi | Mg | graphitization ratio (%) | mean grain diameter | 10 × C⅓ | maximum grain diameter |
|---|---|---|---|---|---|---|---|---|---|---|---|---|---|
| 6 | Example of this invention | 0.019 | | | | | | | | 85 | 5.9 | 8.14 | 8.9 |
| 7 | Example of this invention | 0.029 | | | | | | | | 82 | 5.0 | 8.19 | 12.5 |
| 8 | Example of this invention | 0.030 | | | | | | | | 76 | 4.6 | 8.19 | 10.3 |
| 9 | Example of this invention | 0.036 | | | | | | | | 73 | 4.1 | 8.04 | 14.3 |
| 10 | Example of this invention | 0.021 | | | | | | | | 85 | 3.9 | 8.66 | 14.5 |
| 11 | Example of this invention | 0.022 | | | | | | | | 86 | 4.8 | 7.99 | 13.5 |
| 12 | Example of this invention | 0.034 | 0.0021 | | | | | | | 93 | 4.2 | 7.83 | 12.6 |
| 13 | Example of this invention | 0.029 | | 0.13 | | | | | | 91 | 4.6 | 8.14 | 14.5 |
| 14 | Example of this invention | 0.027 | 0.0021 | | 0.0013 | | | | | 86 | 5.0 | 8.04 | 18.3 |
| 15 | Example of this invention | 0.021 | 0.0025 | | | 0.031 | | | | 88 | 4.7 | 7.99 | 12.0 |
| 16 | Example of this invention | 0.023 | 0.0024 | | | | 0.23 | | | 79 | 5.8 | 8.09 | 11.9 |
| 17 | Example of this invention | 0.027 | | | | | | 0.30 | | 86 | 5.5 | 8.14 | 13.5 |
| 18 | Example of this invention | 0.017 | | | | | | | 0.0060 | 86 | 5.5 | 8.14 | 13.5 |
| 19 | Example of this invention | | | | | | | | 0.0045 | 86 | 5.5 | 8.04 | 13.5 |

TABLE 11

| No. | section | chemical components C | Si | Mn | P | S | sol. N | total N | Cr | Ti | V | Nb | Zr | Mo |
|---|---|---|---|---|---|---|---|---|---|---|---|---|---|---|
| 20 | Example of this invention | 0.32 | 1.23 | 0.42 | 0.013 | 0.027 | 0.0021 | 0.0036 | | | | | | |
| 21 | Example of this invention | 0.32 | 1.27 | 0.54 | 0.023 | 0.012 | 0.0022 | 0.0040 | | | | | | |
| 22 | Example of this invention | 0.26 | 1.83 | 0.51 | 0.003 | 0.015 | 0.0037 | 0.0048 | | | | | | |
| 23 | Example of this invention | 0.32 | 1.17 | 0.45 | 0.020 | 0.025 | 0.0012 | 0.0020 | | | | | | |
| 24 | Example of this invention | 0.25 | 1.20 | 0.60 | 0.026 | 0.020 | 0.0032 | 0.0042 | 0.21 | 0.022 | | | | |
| 25 | Example of this invention | 0.34 | 1.32 | 0.25 | 0.022 | 0.025 | 0.0032 | 0.0065 | 0.25 | 0.023 | | | | |
| 26 | Example of this invention | 0.35 | 1.21 | 0.36 | 0.019 | 0.022 | 0.0023 | 0.0065 | | 0.035 | 0.25 | | | |
| 27 | Example of this invention | 0.35 | 1.19 | 0.81 | 0.027 | 0.023 | 0.0038 | 0.0055 | | | | 0.040 | | |
| 28 | Example of this invention | 0.23 | 1.16 | 0.52 | 0.028 | 0.023 | 0.0041 | 0.0050 | | | | | 0.048 | |
| 29 | Example of this invention | 0.35 | 1.26 | 0.55 | 0.027 | 0.019 | 0.0025 | 0.0046 | | | | | | 0.22 |
| 30 | Example of this invention | 0.31 | 1.26 | 0.75 | 0.028 | 0.025 | 0.0033 | 0.0047 | | | | | | 0.10 |
| 31 | Example of this invention | 0.38 | 1.46 | 0.18 | 0.025 | 0.029 | 0.0015 | 0.0040 | | | | | | |
| 32 | Example of this invention | 0.24 | 1.32 | 0.50 | 0.026 | 0.025 | 0.0039 | 0.0038 | | | | | | |
| 33 | Example of this invention | 0.32 | 1.31 | 0.91 | 0.030 | 0.022 | 0.0042 | 0.0051 | | | | | | |
| 34 | Example of this invention | 0.32 | 1.20 | 0.34 | 0.021 | 0.026 | 0.0042 | 0.0055 | | | | | | |
| 35 | Example of this invention | 0.33 | 1.26 | 0.36 | 0.028 | 0.018 | 0.0037 | 0.0057 | | | | | | |
| 36 | Example of this invention | 0.38 | 1.34 | 0.45 | 0.029 | 0.017 | 0.0026 | 0.0036 | | | | | | |

TABLE 11-continued

| No. | section | chemical components | | | | | | | | | | | | |
|---|---|---|---|---|---|---|---|---|---|---|---|---|---|---|
| | | C | Si | Mn | P | S | sol. N | total N | Cr | Ti | V | Nb | Zr | Mo |
| 37 | Example of this invention | 0.32 | 1.24 | 0.32 | 0.022 | 0.012 | 0.0030 | 0.0045 | | | | | | |

TABLE 12

| No. | section | chemical components | | | | | | | | graphitization ratio | mean grain | | maximum grain |
|---|---|---|---|---|---|---|---|---|---|---|---|---|---|
| | | Al | B | Pb | Ca | Te | Se | Bi | Mg | (%) | diameter | 10 × C⅓ | diameter |
| 20 | Example of this invention | 0.025 | | | | | | | | 81 | 3.5 | 6.84 | 10.1 |
| 21 | Example of this invention | 0.022 | | | | | | | | 76 | 3.7 | 6.84 | 9.8 |
| 22 | Example this invention | 0.022 | | | | | | | | 85 | 2.8 | 6.38 | 10.6 |
| 23 | Example of this invention | | | | | | | | | 88 | 2.4 | 6.84 | 12.3 |
| 24 | Example of this invention | 0.021 | | | | | | | | 76 | 3.5 | 6.30 | 9.8 |
| 25 | Example of this invention | 0.018 | | | | | | | | 77 | 2.2 | 6.98 | 8.3 |
| 26 | Example of this invention | 0.030 | | | | | | | | 88 | 3.5 | 7.05 | 9.6 |
| 27 | Example of this invention | 0.031 | | | | | | | | 75 | 3.8 | 7.05 | 10.6 |
| 28 | Example of this invention | 0.029 | | | | | | | | 74 | 3.7 | 6.13 | 10.2 |
| 29 | Example of this invention | 0.027 | | | | | | | | 85 | 3.6 | 7.05 | 13.2 |
| 30 | Example of this invention | 0.017 | | | | | | | | 89 | 3.5 | 6.77 | 12.5 |
| 31 | Example of this invention | 0.023 | 0.0028 | | | | | | | 91 | 2.8 | 7.24 | 9.8 |
| 32 | Example of this invention | 0.021 | | 0.21 | | | | | | 89 | 3.8 | 6.21 | 12.2 |
| 33 | Example of this invention | 0.026 | 0.0025 | | 0.0016 | | | | | 86 | 3.6 | 6.84 | 9.6 |
| 34 | Example of this invention | 0.022 | 0.0022 | | | 0.021 | | | | 87 | 3.0 | 6.84 | 8.9 |
| 35 | Example of this invention | 0.022 | 0.0023 | | | | 0.25 | | | 95 | 3.6 | 6.91 | 7.9 |
| 36 | Example of this invention | 0.025 | | | | | | 0.29 | | 92 | 3.0 | 7.24 | 9.0 |
| 37 | Example of this invention | 0.001 | | | | | | | 0.0055 | 92 | 3.0 | 6.84 | 9.0 |

TABLE 13

| No. | section | chemical components | | | | | | | | | | | | |
|---|---|---|---|---|---|---|---|---|---|---|---|---|---|---|
| | | C | Si | Mn | P | S | sol. N | total N | Cr | Ti | V | Nb | Zr | Mo |
| 38 | Example of this invention | 0.55 | 0.75 | 0.31 | 0.023 | 0.017 | 0.0020 | 0.0032 | | | | | | |
| 39 | Example of this invention | 0.44 | 0.65 | 0.72 | 0.023 | 0.017 | 0.0021 | 0.0034 | | | | | | |
| 40 | Example of this invention | 0.36 | 0.50 | 1.01 | 0.008 | 0.008 | 0.0019 | 0.0025 | | | | | | |
| 41 | Example of this invention | 0.22 | 0.42 | 0.52 | 0.012 | 0.030 | 0.0042 | 0.0056 | | | | | | |
| 42 | Example of this invention | 0.54 | 0.46 | 0.42 | 0.021 | 0.019 | 0.0022 | 0.0038 | 0.25 | | | | | |
| 43 | Example of this invention | 0.54 | 0.21 | 0.51 | 0.024 | 0.021 | 0.0032 | 0.0052 | | 0.007 | | | | |
| 44 | Example of this invention | 0.55 | 0.55 | 0.36 | 0.022 | 0.024 | 0.0022 | 0.0061 | | 0.025 | | | | |
| 45 | Example of this invention | 0.55 | 0.64 | 0.24 | 0.024 | 0.021 | 0.0048 | 0.0078 | | 0.025 | 0.21 | | | |

TABLE 13-continued

| No. | section | chemical components | | | | | | | | | | | | |
|---|---|---|---|---|---|---|---|---|---|---|---|---|---|---|
| | | C | Si | Mn | P | S | sol. N | total N | Cr | Ti | V | Nb | Zr | Mo |
| 46 | Example of this invention | 0.52 | 0.43 | 0.37 | 0.022 | 0.022 | 0.0035 | 0.0049 | | | | 0.031 | | |
| 47 | Example of this invention | 0.65 | 0.51 | 0.38 | 0.017 | 0.012 | 0.0025 | 0.0051 | | | | | 0.053 | |
| 48 | Example of this invention | 0.51 | 0.35 | 0.48 | 0.027 | 0.028 | 0.0035 | 0.0045 | | | | | | 0.12 |
| 49 | Example of this invention | 0.48 | 0.65 | 0.19 | 0.024 | 0.021 | 0.0019 | 0.0056 | | | | | | 0.11 |
| 50 | Example of this invention | 0.54 | 0.78 | 0.62 | 0.024 | 0.021 | 0.0029 | 0.0043 | | | | | | |
| 51 | Example of this invention | 0.52 | 0.25 | 0.25 | 0.029 | 0.018 | 0.0037 | 0.0062 | | | | | | |
| 52 | Example of this invention | 0.51 | 0.35 | 0.54 | 0.021 | 0.015 | 0.0032 | 0.0055 | | | | | | |
| 53 | Example of this invention | 0.33 | 0.45 | 0.27 | 0.029 | 0.018 | 0.0037 | 0.0058 | | | | | | |
| 54 | Example of this invention | 0.44 | 0.32 | 0.29 | 0.027 | 0.012 | 0.0027 | 0.0064 | | | | | | 0.11 |
| 55 | Example of invention | 0.54 | 0.62 | 0.29 | 0.027 | 0.012 | 0.0021 | 0.0048 | | | | | | |
| 56 | Example of this invention | 0.52 | 0.32 | 0.29 | 0.027 | 0.012 | 0.0024 | 0.0058 | | 0.010 | | | | |

TABLE 14

| No. | section | chemical components | | | | | | | | graphitization ratio | mean grain | | maximum grain |
|---|---|---|---|---|---|---|---|---|---|---|---|---|---|
| | | Al | B | Pb | Ca | Te | Se | Bi | Mg | (%) | diameter | $10 \times C^{1/5}$ | diameter |
| 38 | Example of this invention | 0.027 | | | | | | | | 79 | 4.7 | 8.19 | 12.5 |
| 39 | Example of this invention | 0.023 | | | | | | | | 85 | 4.0 | 7.61 | 13.1 |
| 40 | Example of this invention | | | | | | | | | 82 | 3.6 | 7.11 | 10.5 |
| 41 | Example of this invention | 0.017 | | | | | | | | 92 | 3.5 | 6.04 | 10.2 |
| 42 | Example of this invention | 0.029 | | | | | | | | 72 | 4.9 | 8.14 | 11.3 |
| 43 | Example of this invention | 0.019 | | | | | | | | 85 | 5.6 | 8.14 | 11.8 |
| 44 | Example of this invention | 0.029 | | | | | | | | 82 | 5.8 | 8.19 | 14.5 |
| 45 | Example of this invention | 0.030 | | | | | | | | 76 | 5.5 | 8.19 | 13.0 |
| 46 | Example of this invention | 0.036 | | | | | | | | 73 | 4.6 | 8.04 | 12.7 |
| 47 | Example of this invention | 0.021 | | | | | | | | 85 | 4.2 | 8.66 | 14.5 |
| 48 | Example of this invention | 0.022 | | | | | | | | 86 | 4.3 | 7.99 | 12.5 |
| 49 | Example of this invention | 0.034 | 0.0021 | | | | | | | 93 | 4.4 | 7.83 | 13.6 |
| 50 | Example of this invention | 0.029 | | 0.13 | | | | | | 91 | 5.2 | 8.14 | 15.2 |
| 51 | Example of this invention | 0.027 | 0.0021 | | 0.0013 | | | | | 86 | 5.4 | 8.04 | 14.4 |
| 52 | Example of this invention | 0.021 | 0.0025 | | | | | | | 33 | 4.3 | 7.99 | 11.9 |
| 53 | Example of this invention | 0.023 | 0.0024 | | | | | | | 46 | 4.1 | 6.91 | 12.0 |
| 54 | Example of this invention | 0.027 | | | | | | | | 67 | 4.8 | 7.61 | 14.3 |
| 55 | Example of this invention | 0.027 | | | | | | | 0.0035 | 86 | 4.8 | 8.14 | 14.3 |
| 56 | Example of this invention | | | | | | | | 0.0041 | 86 | 4.8 | 8.04 | 14.3 |

TABLE 15

| No. | section | chemical components | | | | | | | | | | | | |
|---|---|---|---|---|---|---|---|---|---|---|---|---|---|---|
| | | C | Si | Mn | P | S | sol. N | total N | Cr | Ti | V | Nb | Zr | Mo |
| 57 | Comparative Example | 0.55 | 1.23 | 0.34 | 0.019 | 0.017 | 0.0059 | 0.0068 | | | | | | |
| 58 | Comparative Example | 0.49 | 1.19 | 0.40 | 0.021 | 0.020 | 0.0070 | 0.0091 | | | | | | |
| 59 | Comparative Example | 0.52 | 1.20 | 0.29 | 0.015 | 0.012 | 0.0068 | 0.0095 | | | | | | |
| 60 | Comparative Example | 0.35 | 1.18 | 0.35 | 0.021 | 0.026 | 0.0062 | 0.0075 | | | | | | |
| 61 | Comparative Example | 0.35 | 1.21 | 0.31 | 0.011 | 0.019 | 0.0082 | 0.0105 | | | | | | |
| 62 | Comparative Example | 0.53 | 0.75 | 0.41 | 0.029 | 0.027 | 0.0057 | 0.0067 | | | | | | |
| 63 | Comparative Example | 0.46 | 0.69 | 0.41 | 0.022 | 0.021 | 0.0061 | 0.0101 | | | | | | |
| 64 | Comparative Example | 0.36 | 0.75 | 0.34 | 0.024 | 0.021 | 0.0057 | 0.0069 | | | | | | |
| 65 | Comparative Example | 0.58 | 0.35 | 0.50 | 0.021 | 0.026 | 0.0082 | 0.0124 | | 0.01 | | | | |
| 66 | Comparative Example | 0.46 | 0.38 | 0.34 | 0.023 | 0.019 | 0.0059 | 0.0079 | | | | | | |
| 67 | Comparative Example | 0.36 | 0.40 | 0.34 | 0.024 | 0.021 | 0.0057 | 0.0084 | | | | | | |
| 68 | Comparative Example | 0.55 | 1.21 | 0.32 | 0.024 | 0.026 | 0.0068 | 0.0083 | | | 0.11 | | | |
| 69 | Comparative Example | 0.44 | 1.06 | 0.35 | 0.021 | 0.022 | 0.0063 | 0.0092 | | | | 0.014 | | |
| 70 | Comparative Example | 0.47 | 0.71 | 0.50 | 0.029 | 0.021 | 0.0065 | 0.0087 | | | | | | |
| 71 | Comparative Example | 0.53 | 1.12 | 0.36 | 0.022 | 0.027 | 0.0035 | 0.0045 | | | | | | |
| 72 | Comparative Example | 0.51 | 1.21 | 0.35 | 0.019 | 0.019 | 0.0038 | 0.0058 | | | | | | |
| 73 | Comparative Example | 0.36 | 1.22 | 0.35 | 0.014 | 0.022 | 0.0037 | 0.0049 | | | | | | |

TABLE 16

| No. | section | chemical components | | | | | | | | graphitization ratio | mean grain | | maximum grain |
|---|---|---|---|---|---|---|---|---|---|---|---|---|---|
| | | Al | B | Pb | Ca | Te | Se | Bi | Mg | (%) | diameter | $10 \times C^{1/5}$ | diameter |
| 57 | Comparative Example | 0.028 | | | | | | | | 65 | 3.4 | 8.19 | 13.8 |
| 58 | Comparative Example | 0.019 | 0.0026 | | | | | | | 58 | 3.2 | 7.88 | 11.7 |
| 59 | Comparative Example | 0.028 | | | | | | | | 52 | 3.4 | 8.19 | 14.8 |
| 60 | Comparative Example | | | | | | | | | 55 | 4.2 | 7.05 | 8.7 |
| 61 | Comparative Example | 0.021 | | | | | | | | 54 | 4.7 | 7.05 | 12.7 |
| 62 | Comparative Example | 0.028 | | | | | | | | 48 | 4.6 | 8.09 | 10.5 |
| 63 | Comparative Example | 0.019 | | | | | | | | 42 | 4.5 | 7.72 | 12.9 |
| 64 | Comparative Example | 0.021 | 0.0024 | | | | | | | 41 | 4.7 | 7.11 | 13.8 |
| 65 | Comparative Example | 0.010 | | | | | | | | 15 | 4.4 | 8.34 | 10.5 |
| 66 | Comparative Example | 0.019 | | | | | | | | 18 | 4.5 | 7.72 | 12.5 |
| 67 | Comparative Example | 0.021 | 0.0024 | | | | | | | 16 | 1.5 | 7.11 | 10.0 |
| 68 | Comparative Example | 0.015 | | | | | | | | 85 | 4.3 | 8.19 | 25.1 |
| 69 | Comparative Example | 0.027 | 0.0021 | | | | | | | 64 | 4.6 | 7.61 | 26.9 |

TABLE 16-continued

| No. | section | chemical components Al | B | Pb | Ca | Te | Se | Bi | Mg | graphitization ratio (%) | mean grain diameter | 10 × C⅕ | maximum grain diameter |
|---|---|---|---|---|---|---|---|---|---|---|---|---|---|
| 70 | Comparative Example | 0.021 | 0.0021 | | | | | | | 79 | 3.6 | 7.78 | 31.0 |
| 71 | Comparative Example | 0.028 | 0.0025 | | | | | | | 78 | 9.1 | 8.09 | 21.6 |
| 72 | Comparative Example | 0.027 | 0.0028 | | | | | | | 89 | 9.4 | 7.99 | 14.8 |
| 73 | Comparative Example | 0.022 | 0.0021 | | | | | | | 45 | 7.7 | 7.11 | 16.8 |

TABLE 17

| No. | section | machinability | annealing time | annealing hardness (HV) | heating time | hardness |
|---|---|---|---|---|---|---|
| 1 | Example of this invention | 150 | 8 | 121 | 3 | 645 |
| 2 | Example of this invention | 150 | 8 | 124 | 3 | 657 |
| 3 | Example of this invention | 150 | 8 | 127 | 3 | 721 |
| 4 | Example of this invention | 150 | 14 | 126 | 3 | 581 |
| 5 | Example of this invention | 150 | 12 | 125 | 3 | 594 |
| 6 | Example of this invention | 150 | 8 | 120 | 3 | 679 |
| 7 | Example of this invention | 150 | 12 | 122 | 3 | 702 |
| 8 | Example of this invention | 150 | 6 | 128 | 3 | 712 |
| 9 | Example of this invention | 150 | 6 | 124 | 3 | 680 |
| 10 | Example of this invention | 150 | 8 | 126 | 3 | 750 |
| 11 | Example of this invention | 150 | 8 | 119 | 3 | 654 |
| 12 | Example of this invention | 150 | 16 | 126 | 3 | 621 |
| 13 | Example of this invention | 150 | 16 | 127 | 3 | 655 |
| 14 | Example of this invention | 150 | 8 | 124 | 6 | 649 |
| 15 | Example of this invention | 150 | 8 | 125 | 3 | 635 |
| 16 | Example of this invention | 150 | 8 | 120 | 3 | 681 |
| 17 | Example of this invention | 150 | 8 | 123 | 3 | 678 |
| 18 | Example of this invention | 150 | 8 | 123 | 3 | 678 |
| 19 | Example of this invention | 150 | 8 | 123 | 3 | 678 |
| 20 | Example of this invention | 150 | 4 | 119 | 3 | 452 |
| 21 | Example of this invention | 150 | 4 | 125 | 3 | 458 |
| 22 | Example of this invention | 150 | 6 | 124 | 3 | 432 |
| 23 | Example of this invention | 150 | 4 | 122 | 3 | 452 |
| 24 | Example of this invention | 150 | 4 | 128 | 3 | 401 |
| 25 | Example of this invention | 150 | 4 | 124 | 3 | 459 |

TABLE 17-continued

| No. | section | machinability | annealing time | annealing hardness (HV) | heating time | hardness |
|---|---|---|---|---|---|---|
| 26 | Example of this invention | 150 | 6 | 118 | 3 | 481 |
| 27 | Example of this invention | 150 | 4 | 125 | 3 | 446 |
| 28 | Example of this invention | 150 | 4 | 126 | 3 | 385 |

TABLE 18

| No. | section | machinability | annealing time | annealing hardness (HV) | heating time | hardness |
|---|---|---|---|---|---|---|
| 29 | Example of this invention | 150 | 6 | 119 | 3 | 446 |
| 30 | Example of this invention | 150 | 6 | 120 | 3 | 450 |
| 31 | Example of this invention | 150 | 6 | 118 | 3 | 521 |
| 32 | Example of this invention | 150 | 6 | 125 | 3 | 385 |
| 33 | Example of this invention | 150 | 6 | 131 | 3 | 450 |
| 34 | Example of this invention | 150 | 6 | 125 | 3 | 461 |
| 35 | Example of this invention | 150 | 6 | 109 | 3 | 463 |
| 36 | Example of this invention | 150 | 6 | 121 | 3 | 501 |
| 37 | Example of this invention | 150 | 6 | 121 | 3 | 501 |
| 38 | Example of this invention | 150 | 8 | 121 | 3 | 681 |
| 39 | Example of this invention | 150 | 8 | 124 | 3 | 592 |
| 40 | Example of this invention | 150 | 8 | 127 | 3 | 450 |
| 41 | Example of this invention | 150 | 8 | 126 | 3 | 392 |
| 42 | Example of this invention | 150 | 12 | 125 | 3 | 681 |
| 43 | Example of this invention | 150 | 8 | 122 | 3 | 702 |
| 44 | Example of this invention | 150 | 12 | 120 | 3 | 721 |
| 45 | Example of this invention | 150 | 6 | 128 | 3 | 681 |
| 46 | Example of this invention | 150 | 6 | 124 | 3 | 677 |
| 47 | Example of this invention | 150 | 8 | 126 | 3 | 730 |
| 48 | Example of this invention | 150 | 8 | 119 | 3 | 624 |
| 49 | Example of this invention | 150 | 16 | 126 | 3 | 623 |
| 50 | Example of this invention | 150 | 16 | 127 | 3 | 592 |
| 51 | Example of this invention | 150 | 8 | 124 | 3 | 681 |
| 52 | Example of this invention | 150 | 8 | 125 | 3 | 653 |
| 53 | Example of this invention | 150 | 8 | 120 | 3 | 693 |
| 54 | Example of this invention | 150 | 8 | 123 | 3 | 672 |
| 55 | Example of this invention | 150 | 8 | 123 | 3 | 672 |
| 56 | Example of this invention | 150 | 8 | 123 | 3 | 672 |

TABLE 19

| No. | section | machinability | annealing time | annealing hardness (HV) | heating time | hardness |
|---|---|---|---|---|---|---|
| 57 | Comparative Example | 60 | 60 | 138 | 3 | 648 |
| 58 | Comparative Example | 70 | 60 | 141 | 3 | 589 |
| 59 | Comparative Example | 70 | 120 | 135 | 7 | 631 |
| 60 | Comparative Example | 100 | 72 | 145 | 3 | 460 |
| 61 | Comparative Example | 90 | 120 | 132 | 3 | 454 |
| 62 | Comparative Example | 70 | 120 | 145 | 3 | 659 |
| 63 | Comparative Example | 60 | 120 | 141 | 3 | 601 |
| 64 | Comparative Example | 100 | 120 | 135 | 3 | 452 |
| 65 | Comparative Example | 50 | 16 | 152 | 3 | 720 |
| 66 | Comparative Example | 50 | 16 | 141 | 3 | 601 |
| 67 | Comparative Example | 60 | 8 | 145 | 3 | 452 |
| 68 | Comparative Example | 100 | 120 | 152 | 15 | 759 |
| 69 | Comparative Example | 80 | 120 | 148 | 12 | 589 |
| 70 | Comparative Example | 100 | 120 | 148 | 10 | 592 |
| 71 | Comparative Example | 120 | 48 | 125 | 12 | 625 |
| 72 | Comparative Example | 120 | 32 | 126 | 12 | 752 |
| 73 | Comparative Example | 120 | 24 | 126 | 8 | 453 |

INDUSTRIAL APPLICABILITY

The steel for cold forging according to the present invention has excellent surface hardness, excellent deformation properties and machinability, and can be used either as-rolled or under an annealed state for a short time. Moreover, because the steel contains C, the strength can be remarkably improved by heat-treatment, and mechanical components can be produced easily and highly efficiently. Furthermore, the steel for cold forging according to the present invention can shorten the annealing time for softening.

What is claimed is:

1. A structural steel for cold forging, excellent in surface layer hardness and softening properties by annealing, consisting essentially of, in terms of wt %:

C: 0.1 to 1.0%,

Si: 0.1 to 2.0%,

Mn: 0.01 to 1.50%,

P: not greater than 0.100%,

S: not greater than 0.500%,

Sol N: being limited to not greater than 0.005%,

Mg: 0.0005 to 0.02%, and the balance consisting of Fe and unavoidable impurities:

wherein a pearlite ratio in the steel structure (pearlite occupying area ratio in microscope plate/microscope plate area) is not greater than 120×(C %) (with the proviso that the ratio is not greater than 100%), and the outermost layer hardness is at least 450×(C %)+90 in terms of the Vickers hardness Hv.

2. A structural steel for cold forging, excellent in cold formability, cuttability and radio-frequency hardenability, consisting essentially of, in terms of wt %:

C: 0.1 to 1.0%,

Si: 0.1 to 2.0%,

Mn: 0.01 to 1.50%,

P: not greater than 0.100%,

S: not greater than 0.500%,

Sol N: being limited to not greater than 0.005%,

Mg: 0.0005 to 0.02%, and the balance consisting of Fe and unavoidable impurities, and having structure, wherein:

a ratio of graphite amount to the carbon content in the steel (graphitization ratio: the amount of carbon precipitated as graphite/the carbon content in the steel) exceeds 20%, a mean grain diameter of graphite is not greater than $10\times(C\%)^{1/3}$ $\mu$m, and a maximum grain diameter is not greater than 20 $\mu$m.

3. A structural steel for cold forging, excellent in surface layer hardness and softening properties by annealing, and/or excellent in cold formability, cuttability and radio-frequency hardenability, according to claim 1 or 2, wherein the steel further contains at least one of Cr: 0.01 to 0.70%, Mo: 0.05 to 0.50%, Ti: 0.01 to 0.20%, V: 0.05 to 0.50%, Nb: 0.01 to 0.10%, Zr: 0.01 to 0.30%, Al: 0.001 to 0.50%, B: 0.0001 to 0.0060%, Pb: 0.01 to 0.30%, Ca: 0.0001 to 0.0020%, Te: 0.001 to 0.1000%, Se: 0.01 to 0.50%, Bi: 0.01 to 0.50%.

4. A method for producing a structural steel for cold forging, excellent in surface layer hardness and softening properties by annealing, the method comprising the steps of:

hot-rolling a steel consisting essentially of, in terms of wt %:

C: 0.1 to 1.0%,

Si: 0.1 to 2.0%,

Mn: 0.01 to 1.50%,

P: not greater than 0.100%,

S: not greater than 0.500%,

Sol N: being limited to not greater than 0.005%,

Mg: 0.0005 to 0.02%, and the balance consisting of Fe and unavoidable impurities;

said hot rolling taking place in an austenite temperature zone or in an austenite-ferrite dual phase zone so that a pearlite ratio in the steel structure (pearlite occupying area ratio in microscope plate/microscope plate area) is not greater than 120×(C %) % (with the proviso that the ratio is not greater than 100%), and the outermost layer hardness is at least 450×(C %)+90 in terms of the Vickers hardness Hv, cooling the hot-rolled steel immediately after the hot-rolling at a cooling rate of not lower than 1° C./sec, and controlling a recuperative temperature to 650° C. or below.

5. A method for producing a structural steel for cold forging, excellent in cold formability, cuttability and radio-frequency hardenability, the method comprising the steps of:

hot-rolling a steel consisting essentially of, in terms of wt %.

C: 0.1 to 1.0%,

Si: 0.1 to 2.0%,

Mn: 0.01 to 1.50%,

P: not greater than 0.100%,

S: not greater than 0.500%,

Sol N: being limited to not greater than 0.005%,

Mg: 0.0005 to 0.02%, and the balance consisting of Fe and unavoidable impurities;

said hot rolling taking place in an austenite temperature zone or in an austenite-ferrite dual phase zone to obtain a structure having a ratio of graphite amount of the carbon content in the steel (graphitization ratio: the amount of carbon precipitated as graphite/the carbon content in the steel) exceeds 20%, a mean grain diameter of graphite is not greater than $10\times(C\ \%)^{1/3}$ $\mu$m, and a maximum grain diameter is not greater than 20 $\mu$m, cooling the hot-rolled steel immediately after the hot-rolling at a cooling rate of not lower than 1° C./sec, controlling a recuperative temperature to 650° C. or below, and graphitization annealing the recuperated steel at a temperature in the range of 600° C. to 710° C.

6. A method for producing a structural steel for cold forging, excellent in surface layer hardness and softening properties by annealing, and/or excellent in cold formability, cuttability and ratio-frequency hardenability, according to claim 4 or 5, wherein the steel further contains at least one of Cr: 0.01 to 0.70%, Mo: 0.05 to 0.50%, Ti: 0.01 to 0.20%, V: 0.05 to 0.506, Nb: 0.01 to 0.10%, Zr: 0.01 to 0.30%, Al: 0.001 to 0.050%, B: 0.0001 to 0.0060%, Pb: 0.01 to 0.30%, Ca: 0.0001 to 0.0020%, Te: 0.001 to 0.1000, Se: 0.01 to 0.50%, Bi: 0.01 to 0.50%.

* * * * *